US009233038B2

(12) United States Patent
Gibson et al.

(10) Patent No.: US 9,233,038 B2
(45) Date of Patent: Jan. 12, 2016

(54) PATIENT SUPPORT WITH A MICROCLIMATE SYSTEM AND A GRAPHICAL USER INTERFACE

(71) Applicant: Hill-Rom Services, Inc., Batesville, IN (US)

(72) Inventors: Luke Gibson, Greensburg, IN (US); Rachel L. Williamson, Batesville, IN (US); Robert M. Zerhusen, Cincinnati, OH (US); Charles A. Lachenbruch, Lakeway, TX (US); Timothy J. Receveur, Guilford, IN (US); Nicholas C. Batta, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 13/798,390

(22) Filed: Mar. 13, 2013

(65) Prior Publication Data

US 2014/0059766 A1 Mar. 6, 2014

Related U.S. Application Data

(60) Provisional application No. 61/696,745, filed on Sep. 4, 2012.

(51) Int. Cl.

| | |
|---|---|
| ***A61G 7/05*** | (2006.01) |
| ***A47C 21/04*** | (2006.01) |
| ***A61G 7/057*** | (2006.01) |
| *A61G 7/002* | (2006.01) |

(52) U.S. Cl.

CPC . *A61G 7/05* (2013.01); *A47C 21/04* (2013.01); *A47C 21/044* (2013.01); *A61G 7/057* (2013.01); *A61G 7/05769* (2013.01); *A61G 7/002* (2013.01); *A61G 2007/0524* (2013.01); *A61G 2007/0528* (2013.01); *A61G 2007/05784* (2013.01); *A61G 2203/20* (2013.01); *A61G 2203/46* (2013.01); *A61G 2210/70* (2013.01)

(58) Field of Classification Search

USPC ..... 5/421, 423, 600, 611, 615, 641, 644, 5/652.1, 652.2, 658, 695, 724, 726, 940

See application file for complete search history.

(56) References Cited

U.S. PATENT DOCUMENTS

| | | | | | |
|---|---|---|---|---|---|
| 2,726,294 | A | * | 12/1955 | Kroening et al. | 200/61.05 |
| 3,245,068 | A | * | 4/1966 | Brighton et al. | 340/604 |
| 3,678,928 | A | * | 7/1972 | Mozes | 128/886 |
| 4,970,736 | A | * | 11/1990 | Koizumi | 5/607 |
| 5,081,722 | A | * | 1/1992 | Yu | 5/99.1 |
| 5,144,284 | A | * | 9/1992 | Hammett | 340/573.1 |
| 5,291,181 | A | * | 3/1994 | DePonte | 340/573.6 |
| 5,438,721 | A | * | 8/1995 | Pahno et al. | 5/604 |
| 5,459,452 | A | * | 10/1995 | DePonte | 340/573.5 |
| 5,588,167 | A | * | 12/1996 | Pahno et al. | 5/606 |
| 6,011,477 | A | * | 1/2000 | Teodorescu et al. | 340/573.1 |
| 6,384,728 | B1 | * | 5/2002 | Kanor et al. | 340/573.1 |

(Continued)

*Primary Examiner* — Nicholas Polito
*Assistant Examiner* — David R Hare
(74) *Attorney, Agent, or Firm* — Barnes & Thornburg LLP

(57) ABSTRACT

A patient support apparatus includes a surface and a pneumatic system cooperating to provide a microclimate system for reducing moisture at the interface of a patient and the surface. The patient support apparatus further includes a graphical user interface and control circuitry. The control circuitry is configured to adjust operation of the microclimate system in response to sensor outputs from sensors included in the microclimate system and caregiver inputs from the graphical user interface.

35 Claims, 17 Drawing Sheets

(56) References Cited

U.S. PATENT DOCUMENTS

| | | | | |
|---|---|---|---|---|
| 6,583,722 | B2 * | 6/2003 | Jeutter et al. | 340/573.1 |
| 7,962,981 | B2 * | 6/2011 | Lemire et al. | 5/616 |
| 8,281,434 | B2 * | 10/2012 | Skripps | 5/654 |
| 2004/0216235 | A1 * | 11/2004 | Rees | 5/618 |
| 2006/0080778 | A1 * | 4/2006 | Chambers | A47C 21/044 5/652.2 |
| 2010/0005588 | A1 * | 1/2010 | Christopher | 5/423 |
| 2010/0011502 | A1 * | 1/2010 | Brykalski | A47C 21/044 5/423 |
| 2010/0043143 | A1 * | 2/2010 | O'Reagan et al. | 5/421 |
| 2010/0175196 | A1 * | 7/2010 | Lafleche et al. | 5/707 |
| 2011/0092890 | A1 * | 4/2011 | Stryker | A61F 7/007 604/23 |
| 2011/0115635 | A1 * | 5/2011 | Petrovski et al. | 340/584 |
| 2012/0079662 | A1 * | 4/2012 | Dzioba | A61G 7/05776 5/713 |
| 2012/0284918 | A1 * | 11/2012 | Gazagnes | 5/421 |
| 2012/0304381 | A1 * | 12/2012 | Paterok | A47C 21/044 5/423 |
| 2013/0019405 | A1 * | 1/2013 | Flanagan et al. | 5/600 |
| 2013/0067661 | A1 * | 3/2013 | Schwirian et al. | 5/600 |
| 2013/0167296 | A1 * | 7/2013 | Smith | 5/484 |
| 2014/0196210 | A1 * | 7/2014 | Lachenbruch | A61G 7/001 5/423 |

* cited by examiner

PATIENT SUPPORT WITH A MICROCLIMATE SYSTEM AND A GRAPHICAL USER INTERFACE

CROSS-REFERENCE TO RELATED APPLICATIONS

The present application claims the benefit, under 35 U.S.C. §119(e), of U.S. Provisional Application No. 61/696,745, which was filed Sep. 4, 2012, and which is hereby incorporated by reference here.

BACKGROUND

The present disclosure relates to patient support apparatuses such as hospital beds. More particularly, the present disclosure relates to patient support apparatuses including support surfaces, such as hospital bed mattresses, adapted to influence the temperature and/or moisture of a patient's skin as the patient lies on the surface.

Patients lying on patient support surfaces, for periods of time may be susceptible to the development of pressure ulcers (also known as decubitus ulcers or bed sores). The formation of pressure ulcers may be reduced by controlling the temperature and/or moisture at the interface of a patient's skin with the surface. Microclimate systems have been developed to influence the temperature and/or moisture at the interface of a patient's skin with a surface. Sometimes, operation of microclimate systems may be difficult for a caregiver who must provide inputs to the microclimate system based on subjective and sometimes infrequent patient assessments.

SUMMARY

The present invention comprises one or more of the features recited in the appended claims and/or the following features which, alone or in any combination, may comprise patentable subject matter:

A patient support apparatus may include a frame, a surface supported on the frame, a graphical user interface coupled to the frame, and control circuitry. The surface may include a base and a first sensor. The control circuitry may be coupled to the first sensor and to the graphical user interface. The control circuitry may be configured to receive outputs from the first sensor indicative of relative humidity in the support surface and to display a moisture alert on the graphical user interface in response to the outputs received.

In some embodiments, the moisture alert may include a request for a linen change. The moisture alert may indicate an incontinent event.

In some embodiments, the control circuitry may be configured to receive a reset input from the graphical user interface indicative that a linen change has been performed. The control circuitry may also be configured to remove the alert in response to the reset input indicative that the linen change has been performed.

In some embodiments, the control circuitry may be configured to hold for a dry out period of time in response to receiving the reset input from the graphical user interface indicative that a linen change has been performed before displaying another moisture alert on the graphical user interface in response to the outputs received from the first sensor. The control circuitry may be configured to turn on a blower coupled to a topper included in the surface in response to receiving the reset input. It is contemplated that, the control circuitry may be configured to turn off the blower in response to expiration of the dry out period of time.

In some embodiments, the control circuitry may be configured to determine a moisture level based on the outputs from the first sensor indicative of relative humidity in the support surface. The patient support apparatus may also include a clock coupled to the control circuitry. The control circuitry may be configured to store the moisture level and the time from the clock in a memory.

In some embodiments, the control circuitry may be configured to compare the length of time spent at a moisture level to a threshold and to issue the alert if the time spent at the determined moisture level is greater than the threshold. The control circuitry may be configured to turn on a blower coupled to a topper included in the surface in response to the time spent at the determined moisture level being greater than the threshold.

In some embodiments, the control circuitry may be configured to receive a reset input from the graphical user interface indicative that a linen change has been performed. The control circuitry may also be configured to remove the alert and to turn off the blower in response to the reset input.

In some embodiments, the control circuitry may be configured to receive a moisture-status request from the graphical user interface. The control circuitry may also display moisture information in response to receiving the moisture-status request.

In some embodiments, the moisture information may include a line graph showing moisture level over time. The moisture information may include incontinent events over a time period. The moisture information may include a current moisture level.

In some embodiments, the patient support apparatus may also include a second sensor spaced apart from the surface. The control circuitry may be in communication with the second sensor and may be configured to receive outputs from the second sensor indicative of relative humidity in the atmosphere around the support surface. The control circuitry may be configured to compare the outputs from the first sensor and the second sensor to determine a moisture level.

In some embodiments, the surface may include a topper extending over the base. The first sensor may be housed in the base.

According to another aspect of the present disclosure, a patient support apparatus may include a surface, a pneumatic system, a graphical user interface, and control circuitry. The surface may include a base with inflatable bladders, a ticking enveloping the base, and a topper extending over the base and coupled to the ticking. The pneumatic system may include a blower operable at various speeds coupled to the topper of the surface to push air through the topper. The control circuitry may be coupled to the pneumatic system and to the graphical user interface. The control circuitry may be configured to adjust the speed of the blower in response to receipt of a user input from a microclimate control displayed on the graphical user interface.

In some embodiments, the control circuitry may display the microclimate control on the graphical user interface in response to the selection of a microclimate icon displayed on the graphical user interface. The microclimate control may be operable by a user to increase or decrease blower speed. The microclimate control may include one of a flow knob rotatable about an axis between a low position and a high position, a series of selectable flow blocks arranged along a line, a flow slider movable along a line between a low position and a high position, and a pair of selectable flow buttons operable by a user to increase or decrease blower speed.

In some embodiments, the pneumatic system may include an air temperature conditioning unit including a heater and a cooler. The air temperature conditioning unit may be configured to add and remove heat to air passed through the blower to the topper.

In some embodiments, the control circuitry may be configured to adjust the air temperature conditioning unit in response to receipt of a user input from the microclimate control displayed on the graphical user interface. The control circuitry may display the microclimate control on the graphical user interface in response to the selection of a microclimate icon displayed on the graphical user interface.

In some embodiments, the microclimate control may be operable by a user to increase or decrease the temperature of air passed through the blower. The microclimate control may include one of a temperature knob rotatable about an axis between a cool position and a warm position, a series of selectable temperature blocks arranged along a line, a temperature slider movable along a line between a cool position and a warm position, and a pair of selectable temperature buttons.

In some embodiments, the microclimate control may be operable to adjust both the blower speed and the air temperature conditioning unit with the selection of a single value. The microclimate control may include one of an evaporation slider and a moisture removal drop down list.

Additional features, which alone or in combination with any other feature(s), such as those listed above and those listed in the claims, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION

Figure 1:
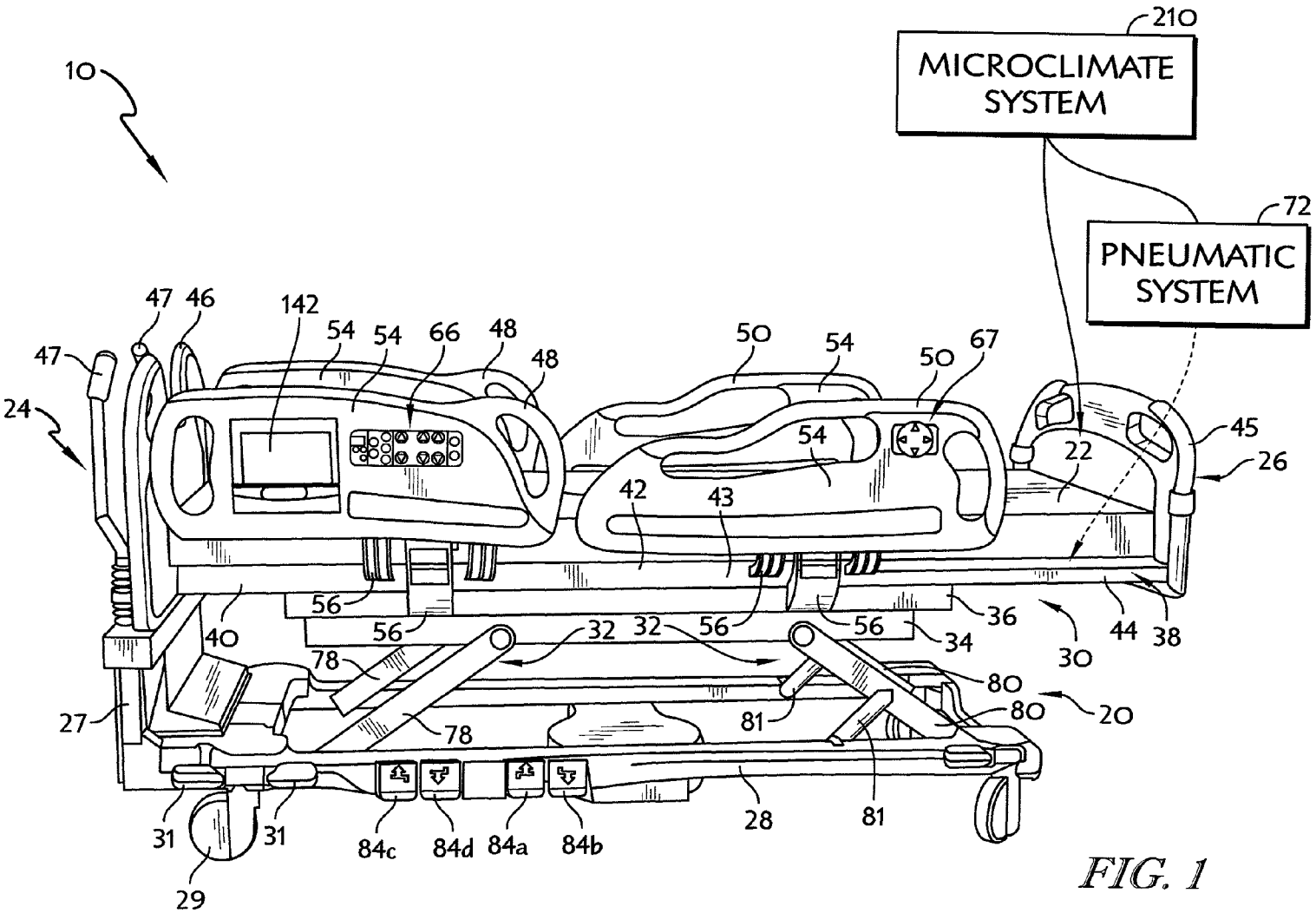
FIG. 1 is a perspective view of a hospital bed including a frame with a graphical display screen and a microclimate system, the microclimate system including a surface (sometimes called a mattress) and a pneumatic system for moving air across the surface to reduce the amount of moisture at the interface of the surface with a patient lying on the surface.

A patient support apparatus, such as illustrative hospital bed 10, includes a patient support structure such as a frame 20 that supports a surface or mattress 22 as shown in FIG. 1. Thus, according to this disclosure a bed frame, a mattress or both are examples of things considered to be within the scope of the term "patient support structure." However, this disclosure is applicable to other types of patient support apparatuses and other patient support structures, including other types of beds, surgical tables, examination tables, stretchers, and the like.

As will be described further herein, the bed 10 includes a microclimate system 210 for influencing the moisture at the interface of a patient's skin with the surface 22. It is contemplated by this disclosure that the microclimate system 210 disclosed herein may be operated automatically based on preprogrammed routines or manually based on user input commands received from a graphical display screen 142 providing a graphic user interface. Additionally, the microclimate system 210 may present current and historical information relating patient skin moisture via the graphical display screen 142 to aid caregivers in providing patient care, preparing treatment plans, making patient records, and tracking patient acuity.

Referring again to FIG. 1, frame 20 of bed 10 includes a base 28, an upper frame assembly 30 and a lift system 32 coupling upper frame assembly 30 to base 28. Lift system 32 is operable to raise, lower, and tilt upper frame assembly 30 relative to base 28. Bed 10 has a head end 24 and a foot end 26. Hospital bed 10 further includes a footboard 45 at the foot end 26 and a headboard 46 at the head end 24. Illustrative bed 10 includes a pair of push handles 47 coupled to an upstanding portion 27 of base 28 at the head end 24 of bed 10. Headboard 46 is coupled to upstanding portion 27 of base 28 as well. Footboard 45 is coupled to upper frame assembly 30. Base 28 includes wheels or casters 29 that roll along a floor (not shown) as bed 10 is moved from one location to another. A set of foot pedals 31 are coupled to base 31 and are used to brake and release casters 29.

Illustrative hospital bed 10 has four siderail assemblies coupled to upper frame assembly 30 as shown in FIG. 1. The four siderail assemblies include a pair of head siderail assemblies 48 (sometimes referred to as head rails) and a pair of foot siderail assemblies 50 (sometimes referred to as foot rails). Each of the siderail assemblies 48, 50 is movable between a raised position, as shown in FIG. 1, and a lowered position (not shown). Siderail assemblies 48, 50 are sometimes referred to herein as siderails 48, 50. Each siderail 48, 50 includes a barrier panel 54 and a linkage 56. Each linkage 56 is coupled to the upper frame assembly 30 and is configured to guide the barrier panel 54 during movement of siderails 48, 50 between the respective raised and lowered positions. Barrier panel 54 is maintained by the linkage 56 in a substantially vertical orientation during movement of siderails 48, 50 between the respective raised and lowered positions.

Upper frame assembly 30 includes a lift frame 34, a weigh frame 36 supported with respect to lift frame 34, and a patient support deck 38. Patient support deck 38 is carried by weigh frame 36 and engages a bottom surface of mattress 22. Patient support deck 38 includes a head section 40, a seat section 42, a thigh section 43 and a foot section 44 in the illustrative example as shown in FIG. 1 and as shown diagrammatically in FIG. 2. Sections 40, 43, 44 are each movable relative to weigh frame 36. For example, head section 40 pivotably raises and lowers relative to seat section 42 whereas foot section 44 pivotably raises and lowers relative to thigh section 43. Additionally, thigh section 43 articulates relative to seat section 42. Also, in some embodiments, foot section 44 is extendable and retractable to change the overall length of foot section 44 and therefore, to change the overall length of deck 38. For example, foot section 44 includes a main portion 45 and an extension 47 in some embodiments as shown diagrammatically in FIG. 2.

In the illustrative embodiment, seat section 42 is fixed in position with respect to weigh frame 36 as patient support deck 38 moves between its various patient supporting positions including a horizontal position, shown in FIG. 1, to support the patient in a supine position, for example, and a chair position (not shown) to support the patient in a sitting up position. In other embodiments, seat section 42 also moves relative to weigh frame 36, such as by pivoting and/or translating. Of course, in those embodiments in which seat section 42 translates along upper frame 42, the thigh and foot sections 43, 44 also translate along with seat section 42. As bed 10 moves from the bed position to the chair position, foot section 44 lowers relative to thigh section 43 and shortens in length due to retraction of the extension 47 relative to main portion 45. As bed 10 moves from the chair position to the bed position, foot section 44 raises relative to thigh section 43 and increases in length due to extension of the extension relative to main portion 45. Thus, in the chair position, head section 40 extends upwardly from weigh frame 36 and foot section extends downwardly from thigh section 43.

Figure 2:
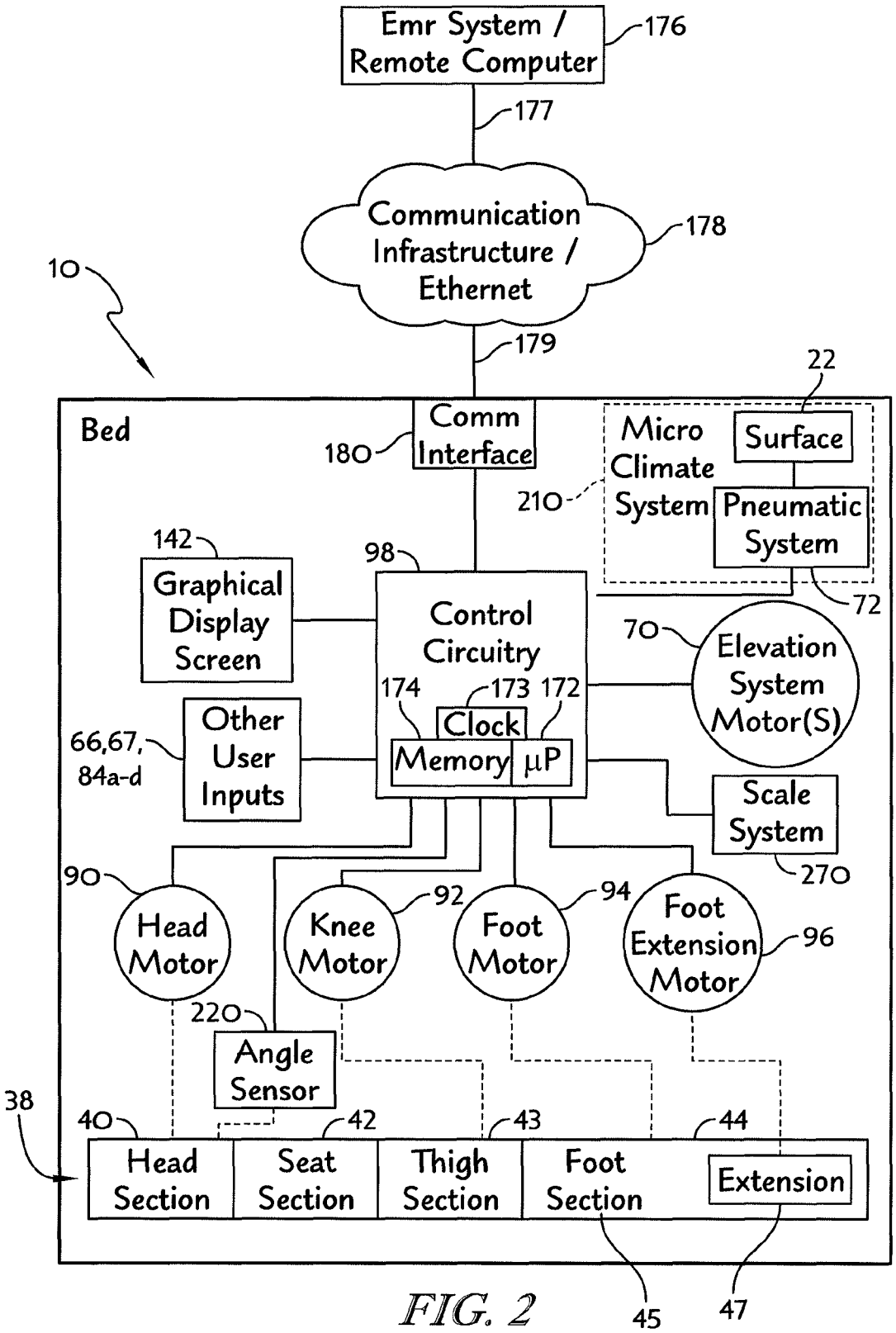
FIG. 2 is a block diagram of the hospital bed of FIG. 1 showing that the hospital bed includes control circuitry coupled to the microclimate system and to the graphic display.

As shown diagrammatically in FIG. 2, bed 10 includes a head motor or actuator 90 coupled to head section 40, a knee motor or actuator 92 coupled to thigh section 43, a foot motor or actuator 94 coupled to foot section 44, and a foot extension motor or actuator 96 coupled to foot extension 47. Motors 90, 92, 94, 96 may include, for example, an electric motor of a linear actuator. In those embodiments in which seat section 42 translates along upper frame 30 as mentioned above, a seat motor or actuator (not shown) is also provided. Head motor 90 is operable to raise and lower head section 40, knee motor 92 is operable to articulate thigh section 43 relative to seat section 42, foot motor 94 is operable to raise and lower foot section 44 relative to thigh section 43, and foot extension motor 96 is operable to extend and retract extension 47 of foot section 44 relative to main portion 44 of foot section 44.

In some embodiments, bed 10 includes a pneumatic system 72 that controls inflation and deflation of various air bladders 226 or cells of mattress 22 and provides air for operation of a microclimate system 210 as described herein. The pneumatic system 72 is represented in FIG. 2 as a single block but that block 72 is intended to represent one or more air sources (e.g., a fan, a blower, a compressor) and associated valves, manifolds, air passages, air lines or tubes, pressure sensors, and the like, as well as the associated electric circuitry, that are typically included in a pneumatic system for inflating and deflating air bladders of mattresses of hospital beds and for operating microclimate systems. In other embodiments, separate pneumatic systems may be provided for the air bladders of a mattress and for the microclimate system of a mattress.

As also shown diagrammatically in FIG. 2, lift system 32 of bed 10 includes one or more elevation system motors or actuators 70, which in some embodiments, comprise linear actuators with electric motors. Thus, actuators 70 are sometimes referred to herein as motors 70. Alternative actuators or motors contemplated by this disclosure include hydraulic cylinders and pneumatic cylinders, for example. The motors 70 of lift system 32 are operable to raise, lower, and tilt upper frame assembly 30 relative to base 28. In the illustrative embodiment, one of motors 70 is coupled to, and acts upon, a set of head end lift arms 78 and another of motors 70 is coupled to, and acts upon, a set of foot end lift arms 80 to accomplish the raising, lowering and tilting functions of upper frame 30 relative to base 28. Guide links 81 are coupled to base 28 and to lift arms 80 in the illustrative example as shown in FIG. 1. Lift system of bed 10 is substantially similar to the lift system of the VERSACARE® bed available from Hill-Rom Company, Inc. Other aspects of bed 10 are also substantially similar to the VERSACARE® bed and are described in more detail in U.S. Pat. Nos. 6,658,680; 6,611,979; 6,691,346; 6,957,461; and 7,296,312, each of which is hereby expressly incorporated by reference herein.

In the illustrative example, bed 10 has four foot pedals 84*a*, 84*b*, 84*c*, 84*d* coupled to base 28 as shown in FIG. 1. Foot pedal 84*a* is used to raise upper frame assembly 30 relative to base 28, foot pedal 84*b* is used to lower frame assembly 30 relative to base 28, foot pedal 84*c* is used to raise head section 40 relative to frame 36, and foot pedal 84*d* is used to lower head section 40 relative to frame 36. In other embodiments, foot pedals 84*a-d* are omitted.

Each siderail 48 includes a first user control panel 66 coupled to the outward side of the associated barrier panel 54 and each siderail 50 includes a second user control panel 67 coupled to the outward side of the associated barrier panel 54. Controls panels 66, 67 include various buttons that are used by a caregiver (not shown) to control associated functions of bed 10. For example, control panel 66 includes buttons that are used to operate head motor 90 to raise and lower the head section 40, buttons that are used to operate knee motor to raise and lower the thigh section, and buttons that are used to operate motors 70 to raise, lower, and tilt upper frame assembly 30 relative to base 28. In the illustrative embodiment, control panel 67 includes buttons that are used to operate motor 94 to raise and lower foot section 44 and buttons that are used to operate motor 96 to extend and retract foot extension 47 relative to main portion 45. In some embodiments, the buttons of control panels 66, 67 comprise membrane switches.

As shown diagrammatically in FIG. 2, bed 10 includes control circuitry 98 that is electrically coupled to motors 90, 92, 94, 96 and to motors 70 of lift system 32. Control circuitry 98 is represented diagrammatically as a single block 98 in FIG. 6, but control circuitry 98 in some embodiments comprises various circuit boards, electronics modules, and the like that are electrically and communicatively interconnected. Control circuitry 98 includes one or more microprocessors 172 or microcontrollers that execute software to perform the various control functions and algorithms described herein and a clock 173 for providing date and time information to the microprocessors 172. The circuitry 98 also includes memory 174 for storing software, variables, calculated values, and the like as is well known in the art.

As also shown diagrammatically in FIG. 2, a user inputs block represents the various user inputs such as buttons of control panels 66, 67 and pedals 84*a-d*, for example, that are used by the caregiver or patient to communicate input signals to control circuitry 98 of bed 10 to command the operation of the various motors 70, 90, 92, 94, 96 of bed 10, as well as commanding the operation of other functions of bed 10. Bed 10 includes at least one graphical user input or display screen 142 coupled to a respective siderail 48 as shown in FIG. 1. Display screen 142 is coupled to control circuitry 98 as shown diagrammatically in FIG. 2. In some embodiments, two graphical user interfaces 142 are provided and are coupled to respective siderails 48. Alternatively or additionally, one or more graphical user interfaces are coupled to siderails 50 and/or to one or both of the headboard 46 and footboard 45. Thus, it is contemplated by this disclosure that a graphical user interface 142 may be coupled to any of barriers 45, 46, 48, 50 of bed 10. Alternatively or additionally, graphical user interface 142 is provided on a hand-held device such as a pod or pendant that communicates via a wired or wireless connection with control circuitry 98.

Control circuitry 98 receives user input commands from graphical display screen 142 when display screen 142 is activated. The user input commands control various functions of bed 10 such as controlling the pneumatic system 72 and therefore, the surface functions of surface 22. In some embodiments, the input commands entered on user interface 142 also control the functions of one or more of motors 70, 90, 92, 94, 96 but this need not be the case. In some embodiments, input commands entered on the user interface 142 also control functions of a scale system.

Various examples of the various alternative or additional functions of bed 10 that are controlled by display screen 142 in various embodiments can be found in U.S. Patent Application Publication Nos. 2008/0235872 A1 and 2008/0172789 A1 and in U.S. application Ser. No. 13/249,336, filed Sep. 30, 2011, and titled "Hospital Bed with Graphical User Interface Having Advanced Functionality," each of which is hereby incorporated by reference herein.

In some embodiments, control circuitry 98 of bed 10 communicates with a remote computer device 176 via communication infrastructure 178 such as an Ethernet of a healthcare facility in which bed 10 is located and via communications links 177, 179 as shown diagrammatically in FIG. 2. Computer device 176 is sometimes simply referred to as a "computer" herein. Remote computer 176 may be part of an electronic medical records (EMR) system, for example. However, it is within the scope of this disclosure for circuitry 98 of bed 10 to communicate with other computers such as those included as part of a nurse call system, a physician ordering system, an admission/discharge/transfer (ADT) system, or some other system used in a healthcare facility in other embodiments. Ethernet 178 in FIG. 2 is illustrated diagrammatically and is intended to represent all of the hardware and software that comprises a network of a healthcare facility.

In the illustrative embodiment, bed 10 has a communication interface or port 180 which provides bidirectional communication via link 179 with infrastructure 178 which, in turn, communicates bidirectionally with computer 176 via link 177. Link 179 is a wired communication link in some embodiments and is a wireless communications link in other embodiments. Thus, communications link 179, in some embodiments, comprises a cable that connects bed 10 to a wall mounted jack that is included as part of a bed interface unit (BIU) or a network interface unit (NIU) of the type shown and described in U.S. Pat. Nos. 7,538,659 and 7,319,386 and in U.S. Patent Application Publication Nos. 2009/0217080 A1, 2009/0212925 A1 and 2009/0212926 A1, each of which are hereby expressly incorporated by reference herein. In other embodiments, communications link 179 comprises wireless signals sent between bed 10 and a wireless interface unit of the type shown and described in U.S. Patent Application Publication No. 2007/0210917 A1 which is hereby expressly incorporated by reference herein. Communications link 177 comprises one or more wired links and/or wireless links as well, according to this disclosure.

Figure 3:
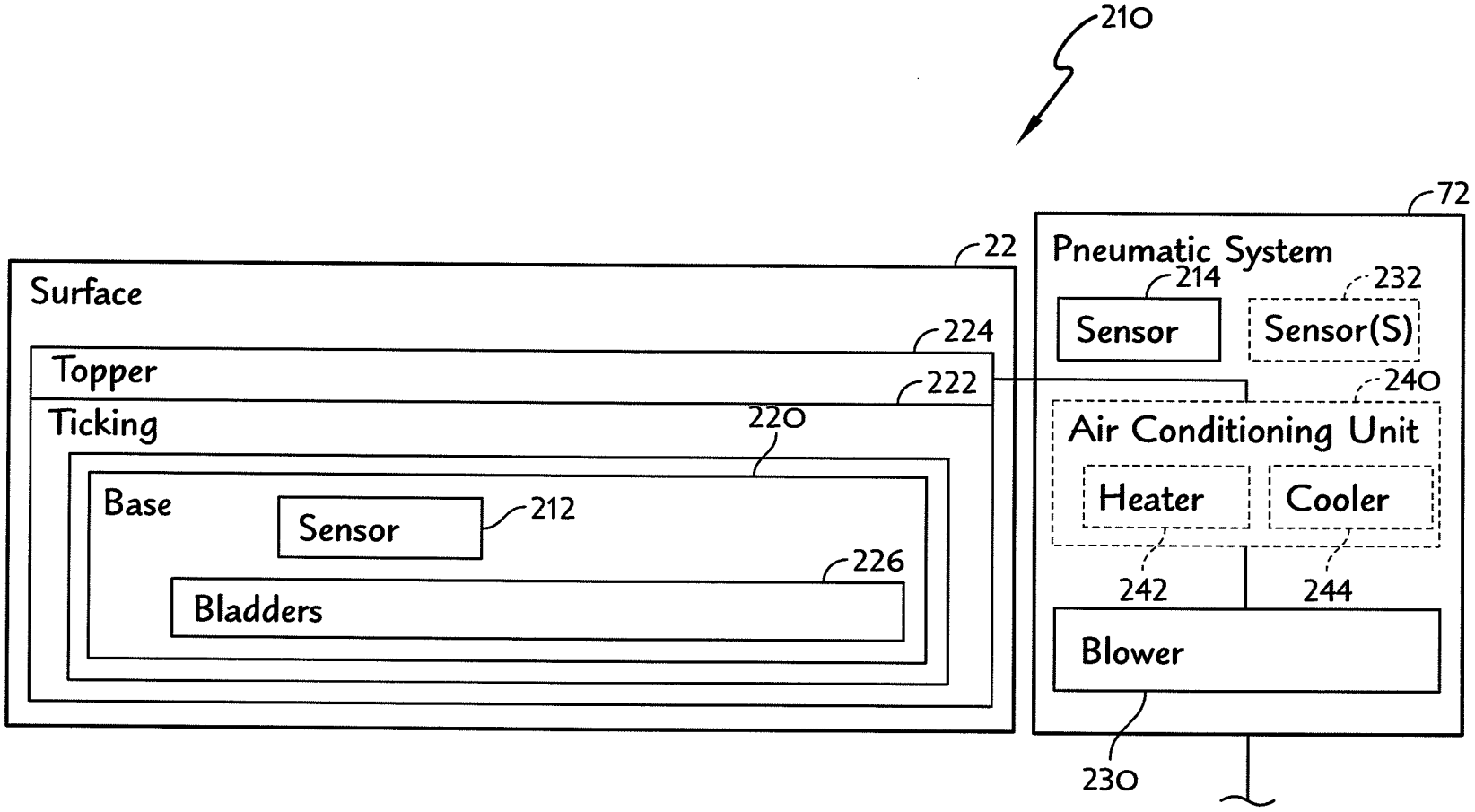
FIG. 3 is a detailed diagrammatic view of the surface and the pneumatic system included in the microclimate system showing that the surface includes a base with inflatable bladders and a sensor configured to detect relative humidity within the surface, ticking enveloping the base, and a topper coupled to the ticking, and showing that the pneumatic system includes a blower coupled to the surface to push air through the topper and a sensor configured to detect relative humidity outside the surface.

According to one embodiment, the surface 22 and the pneumatic system 72 cooperate to provide a microclimate system 210 for influencing the temperature and moisture at the interface of the surface 22 and a patient as suggested diagrammatically in FIGS. 2 and 3. The surface 22 includes a sensor 212 configured to output data corresponding to the relative humidity in the surface 22. The pneumatic system 72 includes a sensor 214 configured to output data corresponding to the relative humidity of the atmosphere outside the surface 22 and a blower 216 configured to move air along a top side 211 of the surface 22.

The microclimate system 210 is coupled to the control circuitry 98 and the control circuitry 98 control circuitry 98 is in communication with the sensors 212, 214 to receive data indicative of relative humidity inside and outside the surface 22 as suggested in FIG. 2. The control circuitry 98 is configured to adjust the operation of the pneumatic system 72 in response to the data from the sensors 212, 214.

The control circuitry 98 also cooperates with the graphical display screen 142 to display information about moisture in the surface 22 based on data from the sensors 212, 214 as suggested, for example, in FIGS. 5-11. The moisture information displayed may aid a caregiver determining treatment plans for a patient or operating the microclimate system 210 as suggested.

The control circuitry 98 further cooperates with the graphical display screen 142 to display interactive controls for the microclimate system 210 as shown in FIGS. 12-17. The graphical display screen 142 is configured to receive user input commands from the interactive controls and to communicate those commands to the control circuitry 98 so that the pneumatic system of the microclimate system 210 is operated as desired by a caregiver.

The surface 22 includes a base 220, ticking 222, and a topper 224 as shown diagrammatically in FIG. 3. The base 220 is configured to support a patient lying on the surface 22 and includes a number of inflatable bladders 226 and the sensor 212. The sensor 212 is illustratively a capacitance-type relative humidity sensor configured to output data indicative of relative humidity outside of the surface 22 (RR) but in other embodiments may be a resistance-type sensor. In some embodiments, the base 220 also includes a sensor 228 configured to output data indicative of patient skin temperature ($T_{PAT}$). The ticking 222 envelopes the base 220 and is illustratively constructed from a liquid-impermeable, vapor-permeable material. The topper 224 is coupled to the ticking 222 and forms the top surface 211 of the surface 22 as suggested in FIG. 3. The topper 224 illustratively includes three-dimensional material through which air is passed to influence the temperature and moisture at the interface of the surface 22 with a patient lying on the surface 22.

The pneumatic system 72 is illustratively housed in the frame 20 of the bed 10 and includes a blower 230 and the sensor 214 as shown diagrammatically in FIG. 3. In other embodiments, the pneumatic system 72 may be housed in a separate cover with the graphic display screen 142 with the cover adapted to be attached to the footboard of a bed 10 as suggested in the screenshots of FIGS. 5 and 6. The blower 230 configured to provide adjustable air flow used to inflate the bladders 226 of the surface 22 and to move air through the topper 224 of the surface 22. In some embodiments, a separate blower may be provided to inflate the bladders 226. The sensor 214 is illustratively a capacitance-type relative humidity sensor configured to output data indicative of relative humidity outside of the surface 22 ($RH_O$) but in other embodiments may be a resistance-type sensor.

In some embodiments, the pneumatic system 72 also includes additional sensors 232 and an air temperature conditioning unit 240 as shown in FIG. 3. The additional sensors 232 are configured to output data indicative of atmospheric conditions outside the surface 22 such as atmospheric temperature (dry bulb) ($T_{ATM}$), ambient air pressure ($P_{ATM}$), and the like. The air temperature conditioning unit 240 is configured to add and remove heat to air passed from the blower 230 to the topper 224. The air temperature conditioning unit 240 includes a heater 242 and a cooler 244.

Figure 4:
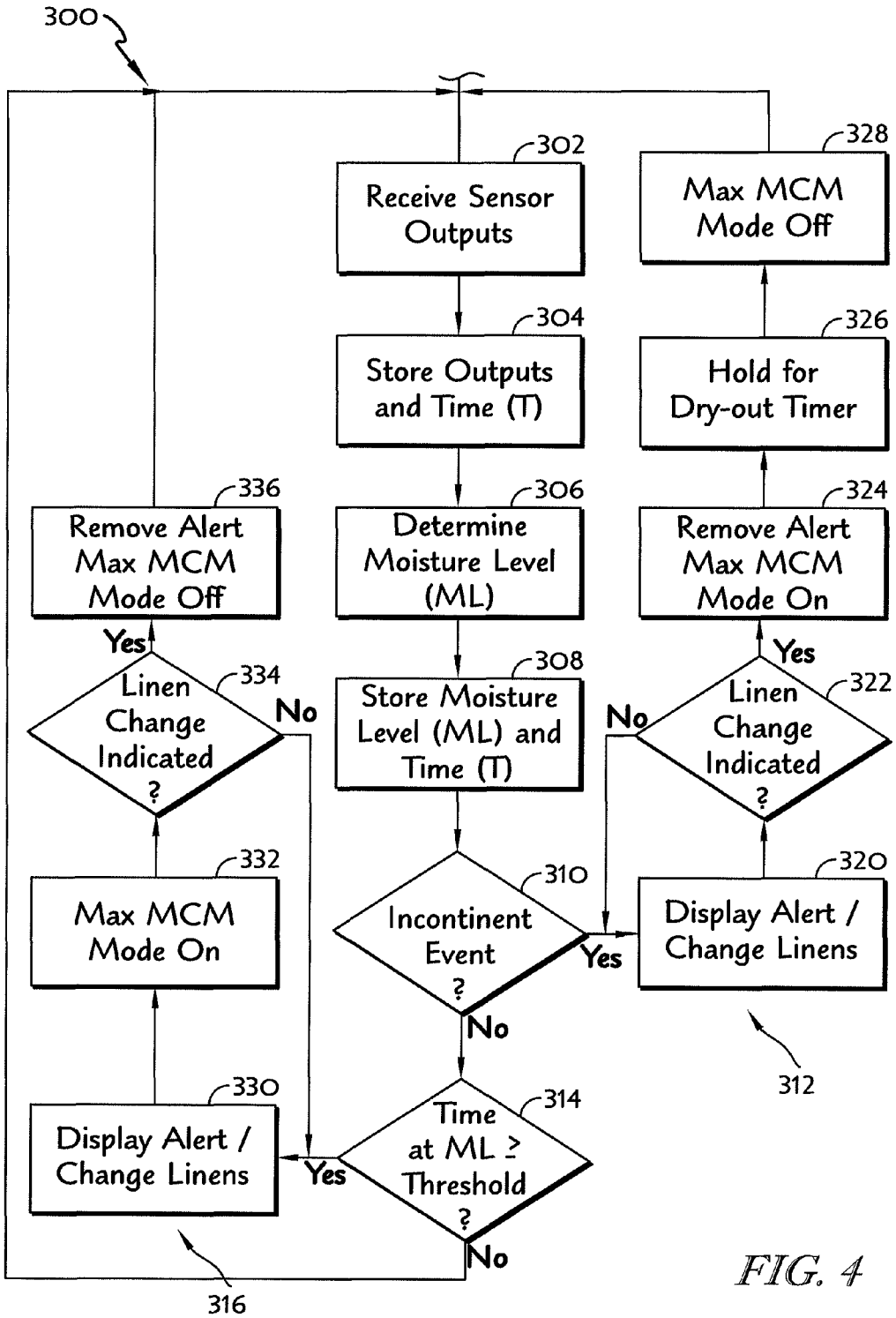
FIG. 4 is a block diagram showing an illustrative routine performed by the control circuitry to operate the microclimate system by receiving sensor outputs, determining the moisture level of a patient from the sensor outputs, and adjusting the microclimate system and graphical display screen in response to the determined moisture conditions.

Automatic control of the microclimate system 210 and the graphical display screen 142 is asserted by the control circuitry 98 according to an illustrative routine 300 shown in FIG. 4. In a step 302, the control circuitry 98 receives the data output from the sensors 212, 214, and 232 and then in a step 304 the control circuitry 98 records the outputs at a time (T).

Once the output from the sensors 212, 214, 232 are recorded, the values are used to determine a moisture level (ML) associated with a patient supported on the surface 22 in a step 306. In the illustrative embodiment, moisture level (ML) is determine on a 1-4 score correlated to the Braden Moisture Scale as suggested in FIG. 9. However, in other embodiments, moisture level (ML) may be correlated with another generic or customized scale as suggested in FIG. 10.

The moisture level (ML) of a patient supported on the surface 22 is illustratively determined as a function of both measured and determined values. The measured values included in the determination of moisture level (ML) non-exclusively include data indicative of relative humidity inside of the surface 22 ($RH_I$) and relative humidity outside of the surface 22 ($RH_O$). In some embodiments, the measured values included used to determine moisture level (ML) may include patient skin temperature ($T_{PAT}$), atmospheric temperature ($T_{ATM}$), and atmospheric air pressure ($P_{ATM}$). The derived values included in the determination of moisture level (ML) non-exclusively include the rate of change of the determined moisture level over time (dML/dT). In some embodiments, the derived values used to determine moisture level (ML) may also include the rate of change of the relative humidity inside of the surface 22 over time ($dRH_I/dT$), the rate of change of the relative humidity outside of the surface 22 ($dRH_O/dT$), the rate of change of patient skin temperature ($dT_{PAT}/dT$), the rate of change of atmospheric temperature ($dT_{ATM}/dT$), and/or the rate of change of atmospheric air pressure ($dP_{ATM}/dT$). Thus, moisture level (ML) may be determined as a function of the form:

$$ML = f\left(RH_I, RH_O, T_{PAT}, T_{ATM}, P_{ATM}, \frac{dML}{dT}, \frac{dRH_I}{dT}, \frac{dRH_O}{dT}, \frac{dT_{PAT}}{dT}, \frac{dT_{ATM}}{dT}, \frac{dP_{ATM}}{dT}, \ldots\right)$$

In a step 308, the control circuitry 98 records the determined moisture level (ML) at a time (T). The stored moisture level (ML) is then compared in a step 310 with an incontinence threshold to determine if a patient has had an incontinent event on the surface 22. If the incontinence threshold is exceeded, then the control circuitry 98 begins an incontinent event subroutine 312 for alerting a caregiver and automatically operating the microclimate system 210. If the incontinence threshold is not exceeded, then the control circuitry 98 continues on to a step 314.

In the step 314, the control circuitry compares the time a patient has spent at a moisture level (ML) with an excessive moisture threshold corresponding to that moisture level (ML). In the illustrative embodiment, the excessive moisture threshold at a moisture level of (1) is between about two and eight hours, at a moisture level (ML) of (2) is about twelve hours, at a moisture level (ML) of (3) is about twenty-four hours, and at a moisture level (ML) of (4) is infinite.

Additionally, in step 314, time spent at a current moisture level (ML) is added to the time spent at an immediately previous moisture level (ML). The summation of time is compared to the excessive moisture threshold corresponding to the immediately previous moisture level (ML). If an excessive moisture threshold is exceeded, then the control circuitry 98 begins an excessive moisture subroutine 316 for alerting a caregiver and automatically operating the microclimate system 210. If no excessive moisture thresholds are exceeded, then the control circuitry 98 loops back to step 302 as shown in FIG. 4.

Figure 5:
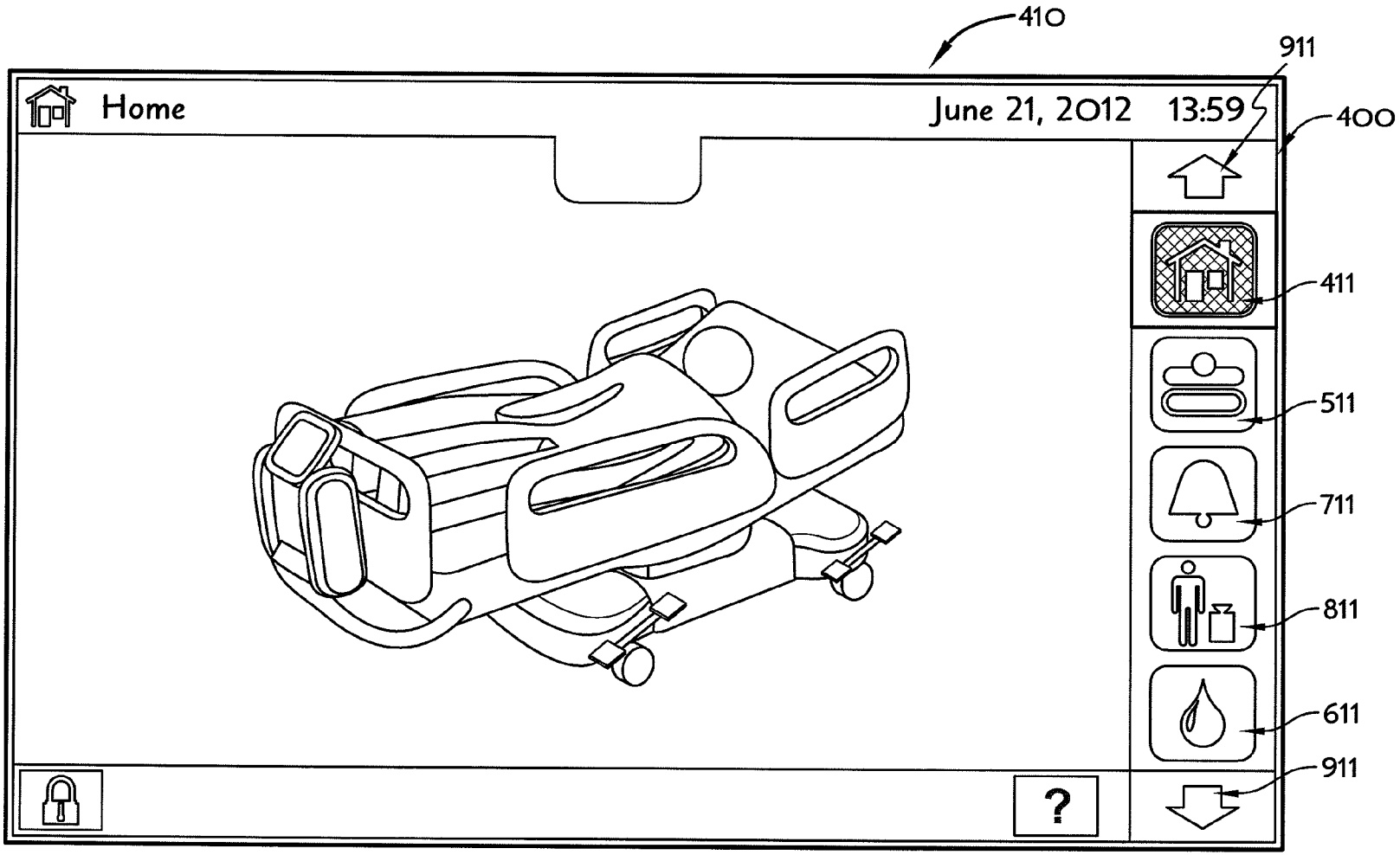
FIG. 5 is a screen shot of a home screen displayed on the graphical user interface showing that the home screen includes a number of selectable icons associated with a number of bed functions including microclimate system control.
Figure 6:
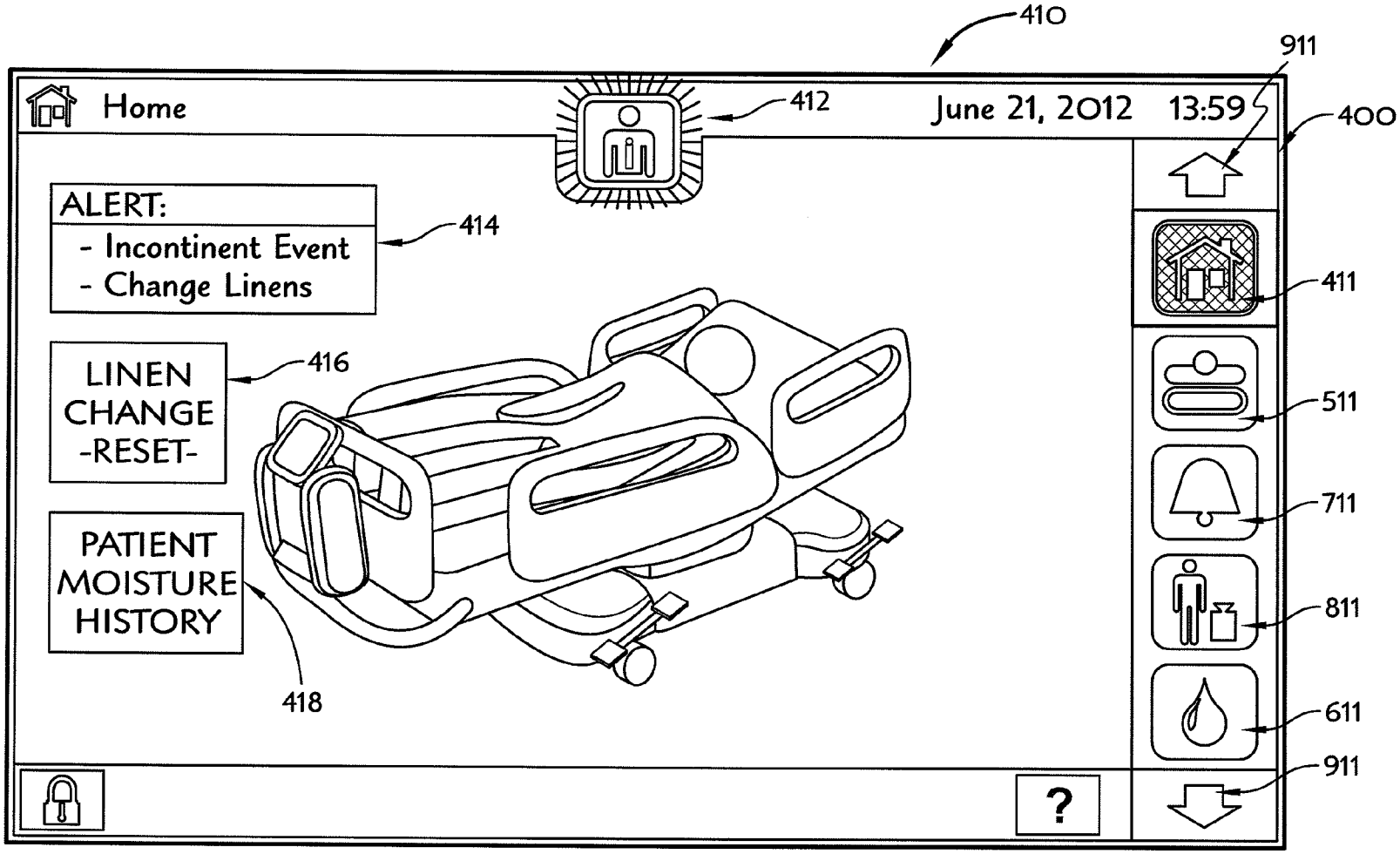
FIG. 6 is a screen shot of the home screen updated to include a flashing alert icon and alert information associated with a moisture condition, a linen change reset button, and a patient moisture history button that can be pressed to display a patient moisture history screen as shown in FIG. 9.
Figure 7:
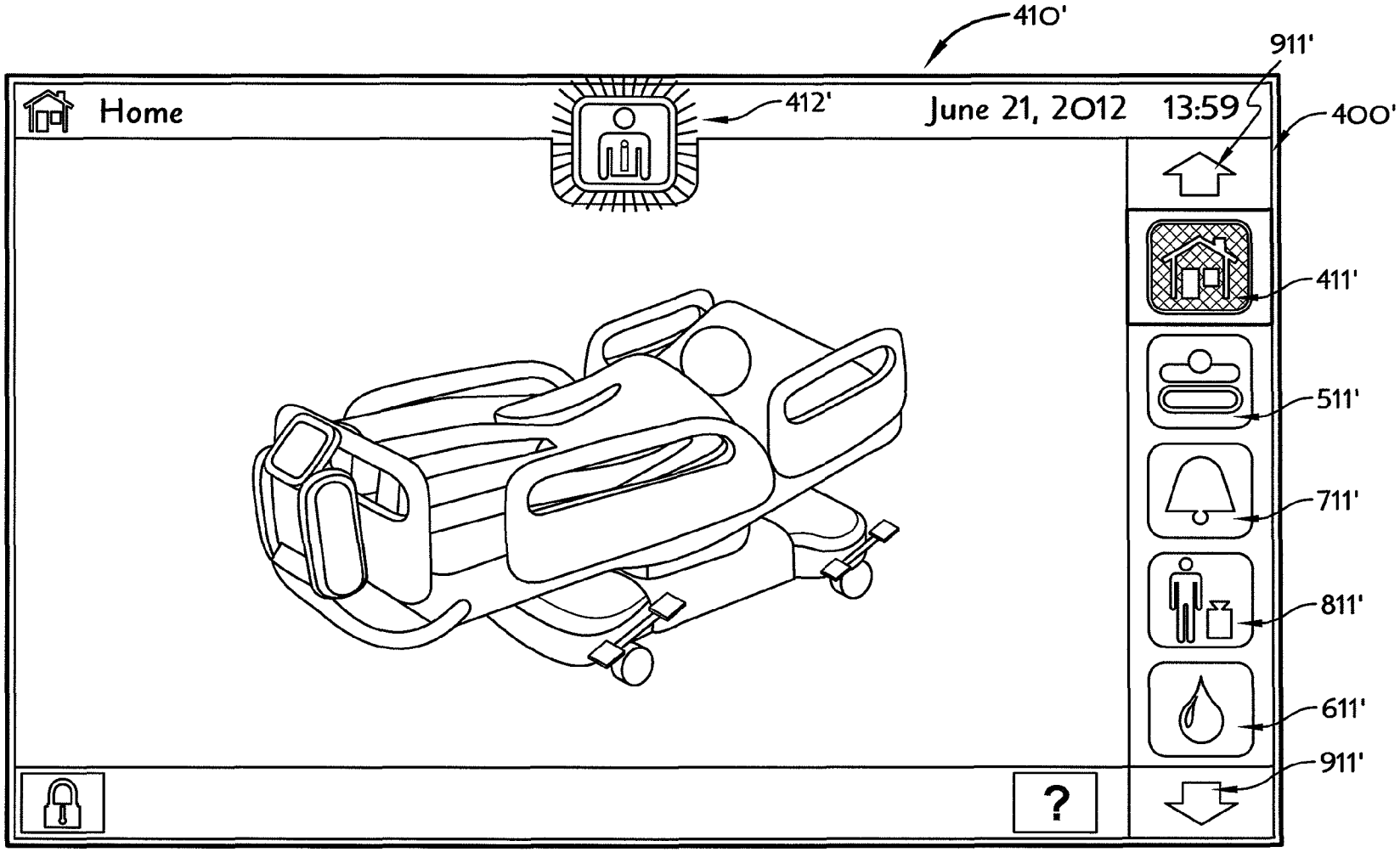
FIG. 7 is a screen shot of an alternative home screen updated to include a flashing alert icon that can be pressed to the display an alert screen including alert information as shown in FIG. 8.

The incontinent event subroutine 312 includes a step 320 in which the control circuitry 98 updates a home screen 410 shown in FIG. 5 to include a flashing alert icon 412, alert information 414 indicating an incontinent event and requesting a linen change, a linen change indicator button 416, and a patient moisture history button 418 as shown in FIG. 6. In an alternative embodiment, a home screen 410' is updated in step 320 to include only a flashing alert icon 412' as shown in FIG. 7. In such embodiments, when a caregiver presses the flashing alert icon 412' on the home screen 410', an alert screen 420' including alert information 414', a linen change indicator button 416', and a patient moisture history button 418' is displayed by the control circuitry 98.

The updated home screen 410 remains displayed until a user indicates that the linens of the bed 10 have been changed as suggested in decision step 322 of incontinent event subroutine 312 shown in FIG. 4. When a caregiver indicates that a linen change has been performed by pressing the linen change indicator button 416 (or 416') on the graphical display screen 142, the control circuitry 98 proceeds to a step 324.

In step 324, the circuitry 98 displays the home screen 410 without the flashing alert icon 412, alert information 414, the linen change indicator button 416, or the patient moisture history button 418 as shown in FIG. 5. The circuitry 98 also turns on the pneumatic system 72 of the microclimate system 210 to a maximum evaporation mode. Illustratively, the maximum evaporation mode includes turning the blower 230 to a high flow setting and turning heater 242 to a warm setting adding heat to air moved by the blower 230 through the topper 224. Thus, the microclimate control system 210 is operated to remove excess moisture from the surface 22.

In a step 326, the control circuitry 98 holds the pneumatic system 72 in the maximum evaporation mode for a period of time determined by a dry out timer. During the period to time that the maximum evaporation mode is running, excess moisture held in the sensor 212 is substantially reduced as the sensor 212 dries out. When the sensor 212 is sufficiently dried out, the control circuitry 98 can loop back to receive new sensor outputs without providing false indications of high relative humidity in the surface 22. In some alternative embodiments, the control circuitry 98 may wait for the sensor 212 to dry out after an incontinent event without turning on the maximum evaporation mode. When the dry out timer has expired, the control circuitry 98 moves to a step 328 turning off the maximum evaporation mode and then looping back to step 302 receiving new sensor outputs.

Figure 8:
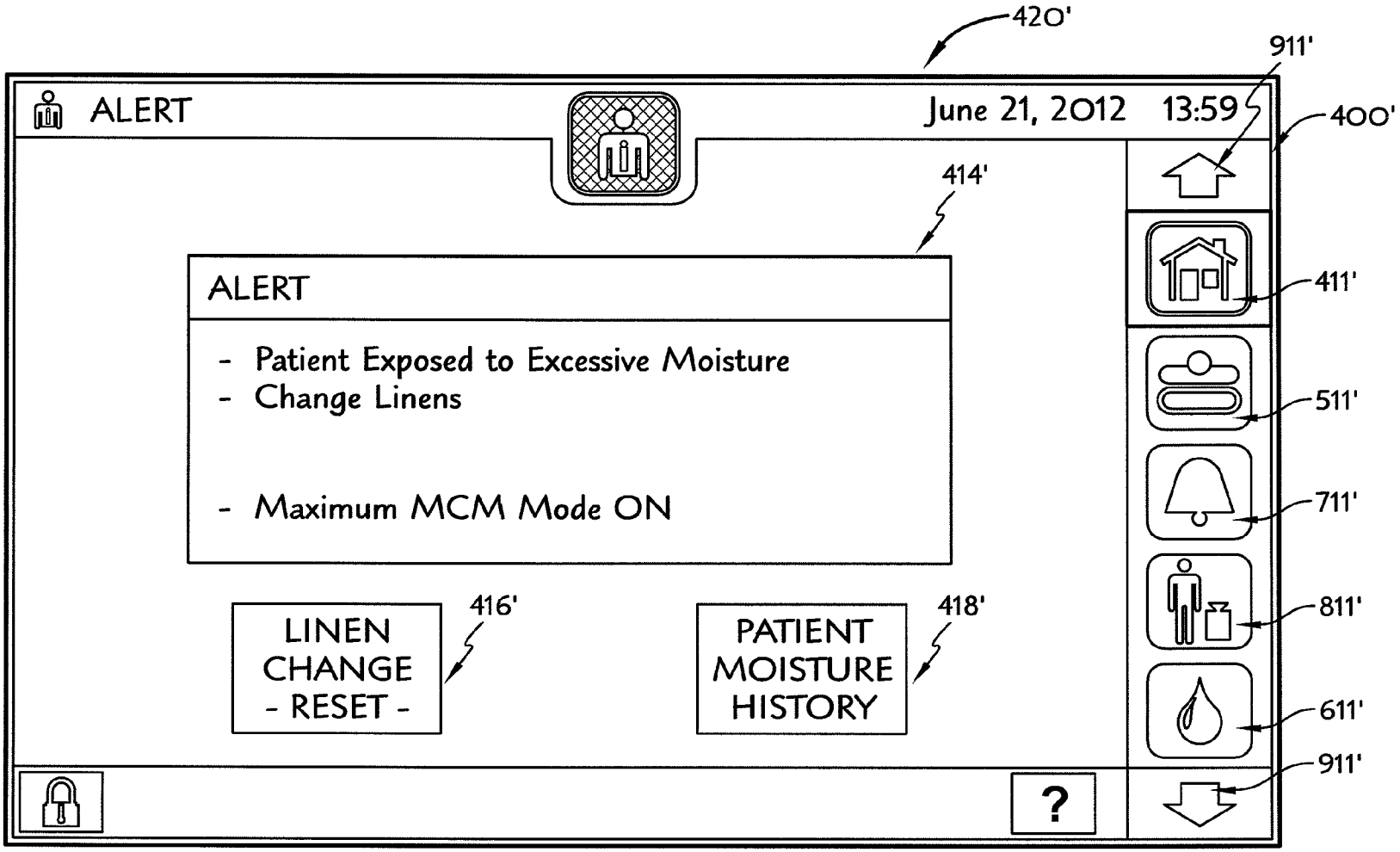
FIG. 8 is a screen shot of an alert screen displayed after an alert icon is selected by a caregiver showing that the alert screen includes alert information associated with a moisture condition, a linen change reset button, and a patient moisture history button that can be pressed to display a patient moisture history screen as shown in FIG. 9.

The excess moisture event subroutine 316 includes a step 330 in which the control circuitry 98 updates the home screen 410 shown in FIG. 5 to include a flashing alert icon 412, alert information 414 indicating a excess moisture event and requesting a linen change, a linen change indicator button 416, and a patient moisture history button 418. In an alternative embodiment, the home screen 410' is updated in step 330 to include only a flashing alert icon 412' as shown in FIG. 7. In such embodiments, when a caregiver presses the flashing alert icon 412' on the home screen 410', an alert screen 420' including alert information 414', a linen change indicator button 416', and a patient moisture history button 418' is displayed by the control circuitry 98 as shown in FIG. 8.

The excess moisture event subroutine 316 then advances to a step 332 and turns on the pneumatic system 72 of the microclimate system 210 to the maximum evaporation mode. Thus, the microclimate control system 210 is operated to remove excess moisture from the surface 22.

The updated home screen 410 remains displayed and the microclimate system 210 remains in the maximum evaporation mode until a user indicates that the linens of the bed 10 have been changed as suggested in decision step 334 of excess moisture event subroutine 316 shown in FIG. 4. When a caregiver indicates that a linen change has been performed by pressing the linen change indicator button 416 (or 416') on the graphical display screen 142, the control circuitry 98 proceeds to a step 336.

In step 336, the circuitry 98 displays the home screen 410 without the flashing alert icon 412, alert information 414, the linen change indicator button 416, or the patient moisture history button 418 as shown in FIG. 5. The circuitry 98 also turns off the maximum evaporation mode of the pneumatic system 72 returning the microclimate system 210 to whatever operating conditions were in place prior to the excess moisture event subroutine. The control circuitry then loops back to step 302 receiving new sensor outputs.

Figure 9:
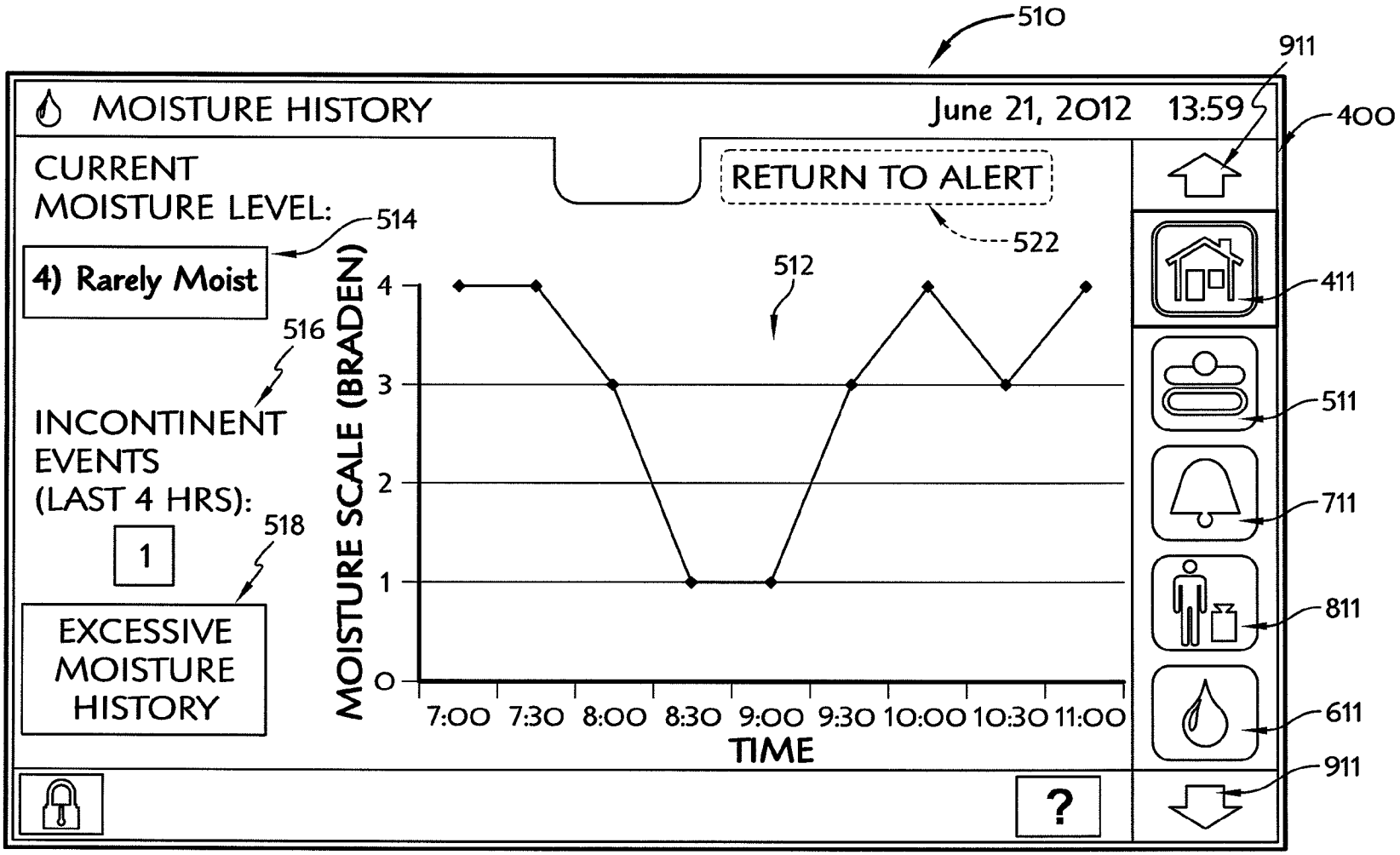
FIG. 9 is a screen shot of a patient moisture history screen showing that the moisture history screen includes a graph showing moisture level corresponding to the Braden Moisture Scale over time, a current moisture level, an incontinent event counter, and an excessive moisture history button that can be pressed to display an excessive moisture history screen as shown in FIG. 11.
Figure 11:
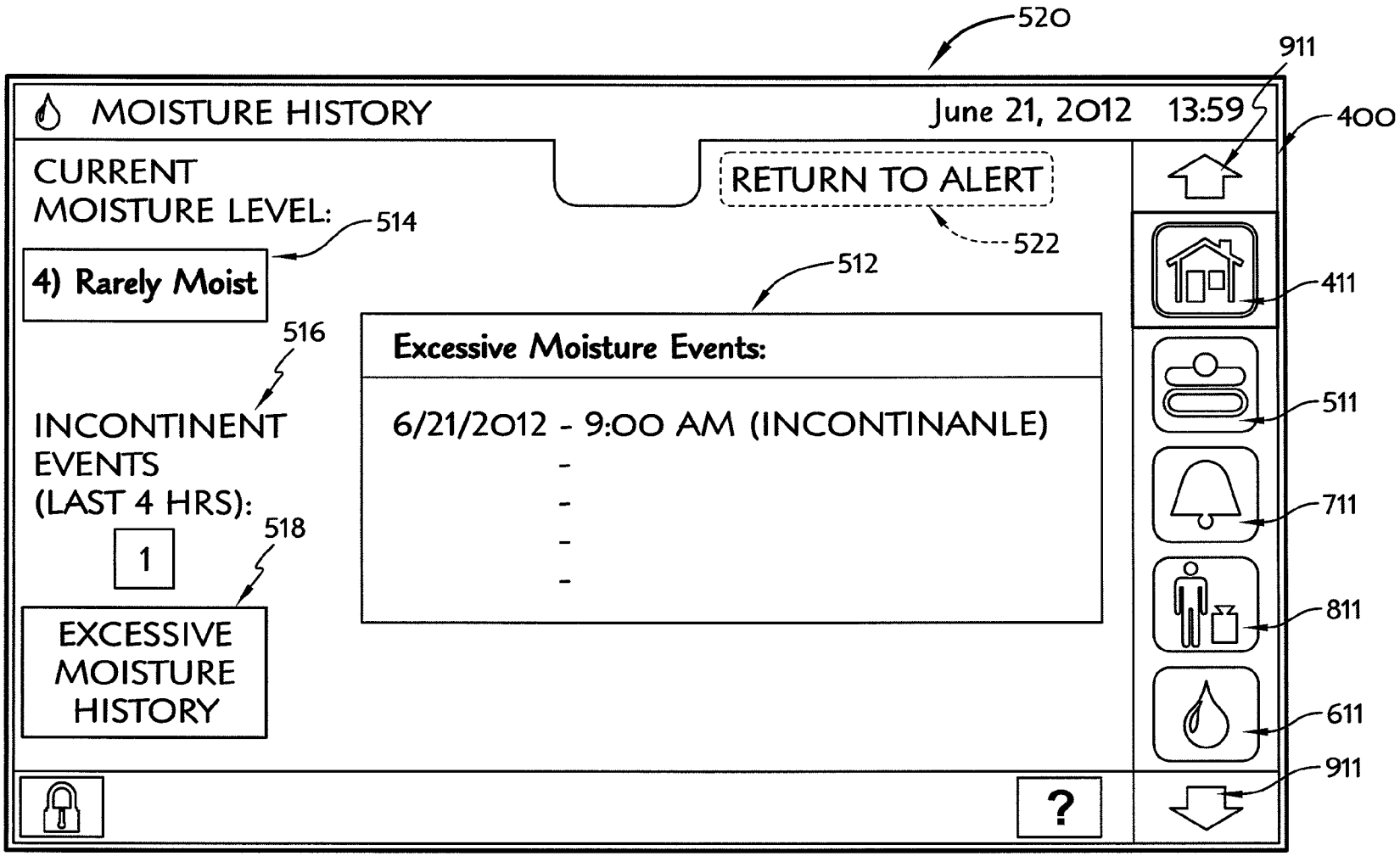
FIG. 11 is an excessive moisture history screen including a list of times associated with incontinent or excessive moisture events.

In addition to automatic performance of routine 300, the control circuitry 98 is configured to display a moisture history screen 510 in response to a user pressing the moisture history button 418 as shown in FIG. 9. The moisture history screen 510 is configured to inform a caregiver about a patient's moisture history (moisture-status) so that the caregiver can plan treatments, chart trends, and track patient progress. The moisture history screen 510 includes a line graph 512 showing moisture level (ML) corresponding to the Braden Moisture Scale over time, a current moisture level 514, an incontinent event counter 516, and an excessive moisture history button 518 that can be pressed to display an excessive moisture history screen 520 as shown in FIG. 11. Additionally, when the moisture history screen 510 is reached from the home screen 410 including alert information or from the alert screen 420', the moisture history screen 510 includes a return to alert button 522 that can be pressed to display the previous screen.

Figure 10:
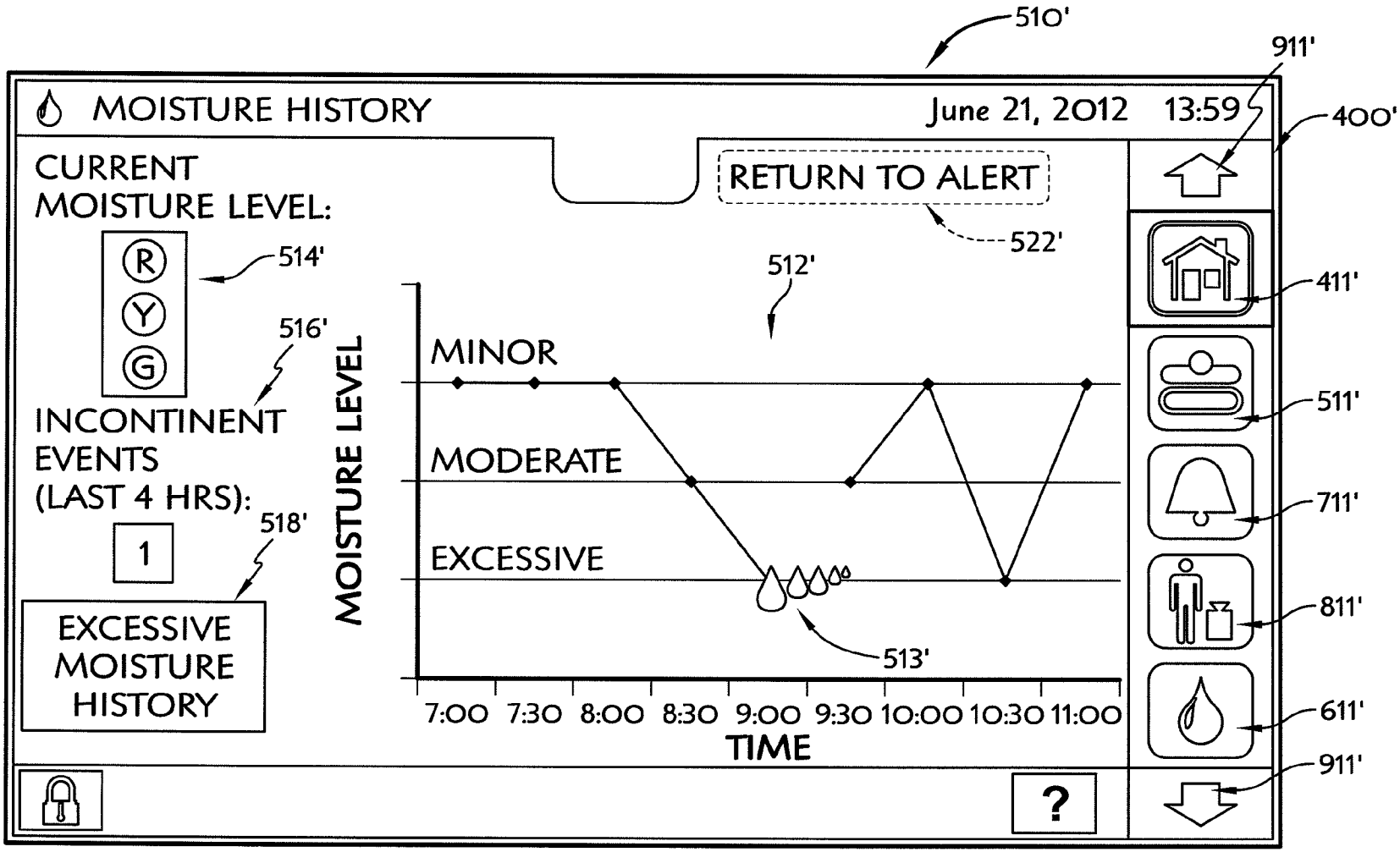
FIG. 10 is a screen shot of an alternative patient moisture history screen showing that the moisture history screen includes a graph showing moisture level on a custom scale over time, a current moisture level stoplight icon, an incontinent event counter, and an excessive moisture history button that can be pressed to display an excessive moisture history screen as shown in FIG. 11.

An alternative moisture history screen 510' is shown in FIG. 10. The alternative moisture history screen 510' is substantially similar to moisture history screen 510. Unlike screen 510, screen 510' includes a line graph 512' that shows moisture level corresponding to a custom scale and a current moisture level 514' shown on a stoplight icon also corresponding to the custom scale. Additionally, alternative moisture history screen 510' includes a dry out time icon 513' indicating that the sensor 212 is drying out and that no moisture readings are being received. The dry out time icon 513' is illustratively a series of shrinking and dimming droplets included in the line graph 512' as shown in FIG. 10.

The excessive moisture history screen 520 shown in FIG. 11 is substantially similar to the moisture history screen 510 except that the line graph 512 is replaced with a list 525 of times associated with incontinent or excessive moisture events and the excessive moisture history button 518 is shaded. The list 525 quickly shows a caregiver about a patient's moisture history to aid in treatment planning, charting, and patient progress tracking A caregiver can press the excessive moisture history button 518 again to return to the moisture history screen 510 (or 510').

Figure 12:
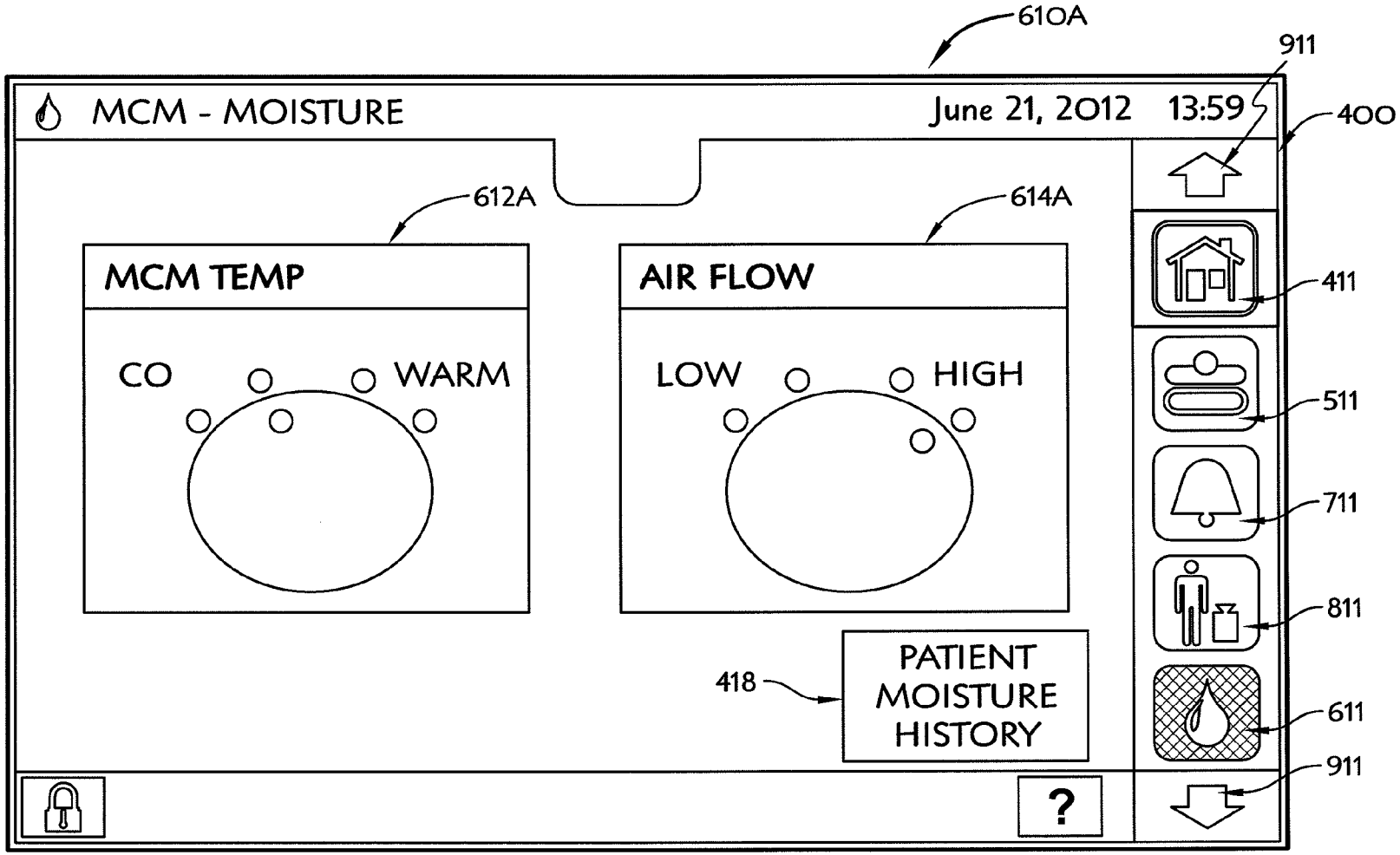
FIG. 12 is a microclimate system control screen including a rotatable microclimate temperature control knob, a rotatable air flow control knob, and a patient moisture history button that can be pressed to display the patient moisture history screen as shown in FIG. 9.

Manual control of the microclimate system 210 is asserted by a caregiver providing user input commands to the graphical display screen 142 on a microclimate control screen 610A shown in FIG. 12. The microclimate control screen 610 is accessed by a user pressing a microclimate icon 611 included in a list of menu icons 400 provided on each screen displayed by the control circuitry 98.

The microclimate control screen 610A illustratively includes a temperature input 612A, an air flow input 614A, and the patient moisture history button 418 as shown, for example, in FIG. 12. The temperature input 612A is configured send a user input command to the control circuitry 98 so that the control circuitry 98 adjusts the air temperature conditioning unit 240 to add or remove heat from air moved through the topper 224. The temperature input 612A in the illustrative embodiment is a rotatable microclimate temperature control knob as shown in FIG. 12. The air flow input 614A is configured send a user input command to the control circuitry 98 so that the control circuitry 98 adjusts the speed of the blower 230 to move more or less air through the topper 224. The air flow input 614A in the illustrative embodiment is a rotatable air flow control knob as shown in FIG. 12.

Figure 13:
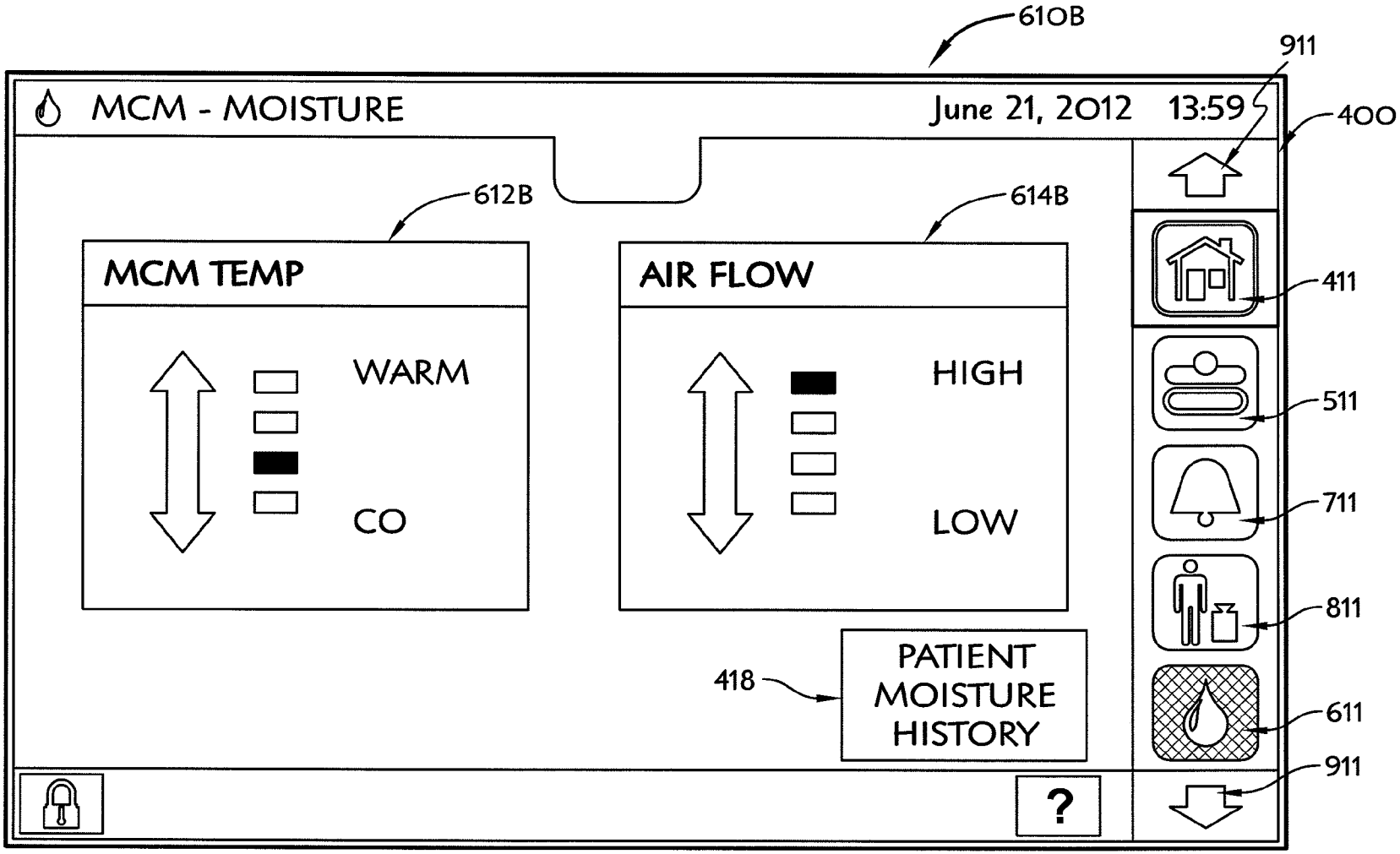
FIG. 13 is an alternative microclimate system control screen similar to FIG. 12, the screen including a series of selectable temperature control blocks, a series of selectable flow control blocks, and a patient moisture history button.

An alternative microclimate control screen 610B is shown in FIG. 13. The alternative microclimate control screen 610B is substantially similar to microclimate control screen 610A except that the temperature input 612B is a series of selectable temperature control blocks and the air flow input 614B is a series of selectable flow control blocks as shown in FIG. 13.

Figure 14:
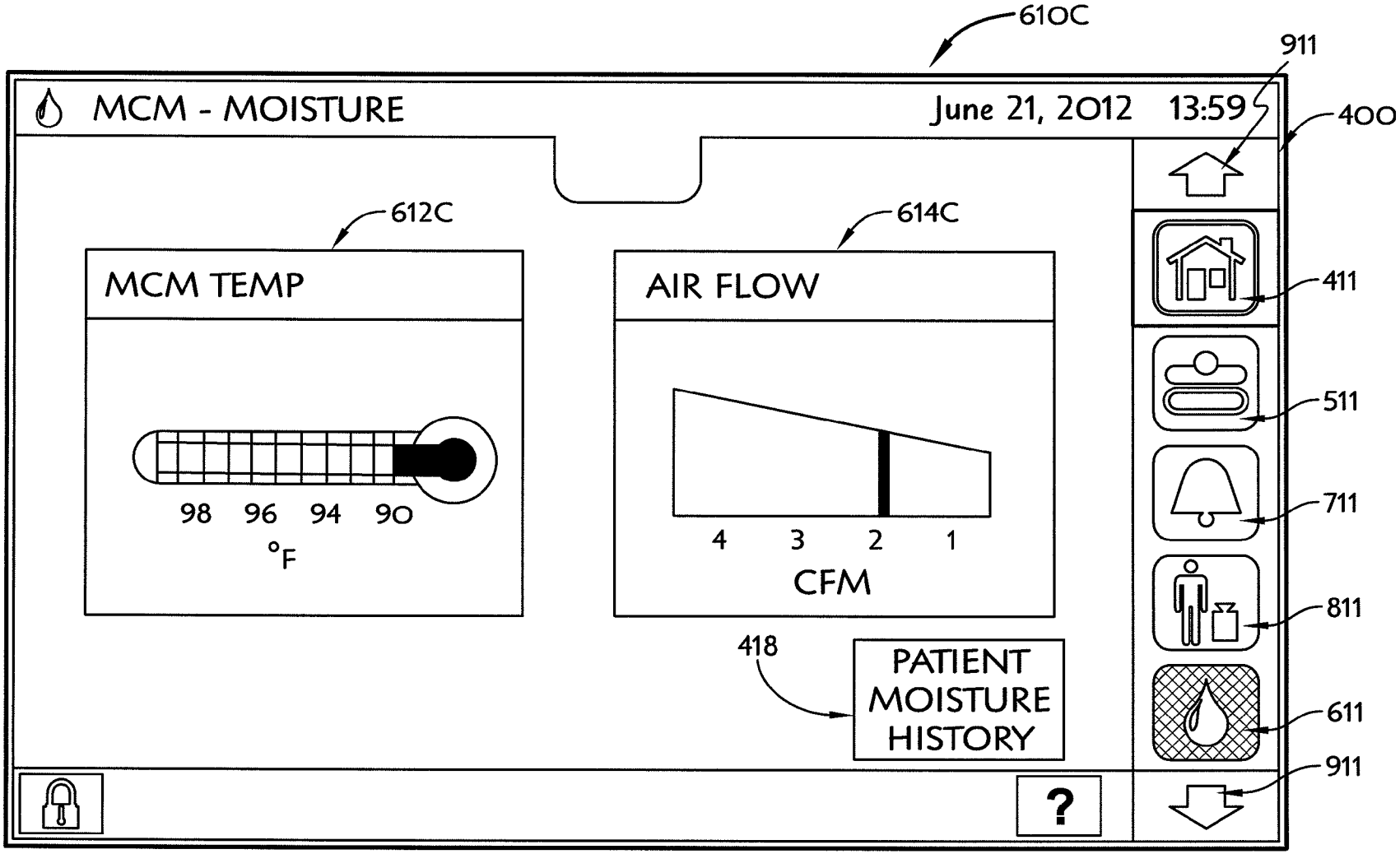
FIG. 14 is another alternative microclimate system control screen similar to FIGS. 12 and 13, the screen including a temperature control slider embodied as a thermometer icon, a flow control slider, and a patient moisture history button.

Another alternative microclimate control screen 610C is shown in FIG. 14. The alternative microclimate control screen 610C is substantially similar to microclimate control screen 610A except that the temperature input 612C is a temperature control slider embodied as a thermometer icon and the air flow input 614C is a flow control slider as shown in FIG. 14.

Figure 15:
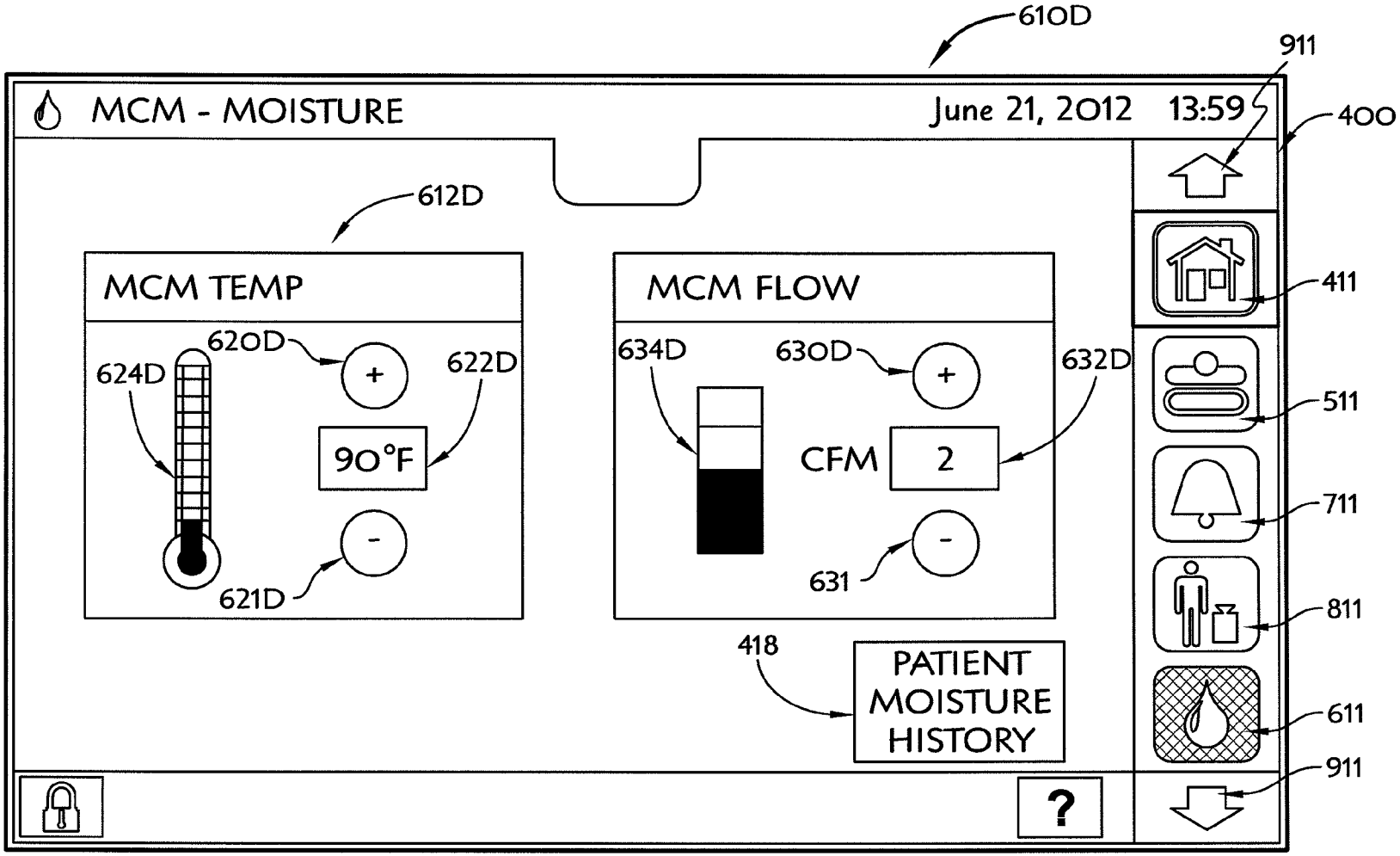
FIG. 15 is another alternative microclimate system control screen similar to FIGS. 12-14, the screen including a pair of temperature control buttons arranged near a desired temperature indicator and a desired temperature thermometer icon, a pair of flow control buttons arranged near a desired flow indicator and a desired flow icon, and a patient moisture history button.

Another alternative microclimate control screen 610D is shown in FIG. 15. The alternative microclimate control screen 610D is substantially similar to microclimate control screen 610A except that the temperature input 612D is a pair of temperature control buttons 620D, 621D arranged near a numerical desired temperature indicator 622D and a desired temperature thermometer icon 624D and the air flow input 614D is a pair of flow control buttons 630D, 631D arranged near a desired flow indicator 632D and a desired flow icon 634D as shown in FIG. 15.

Figure 16:
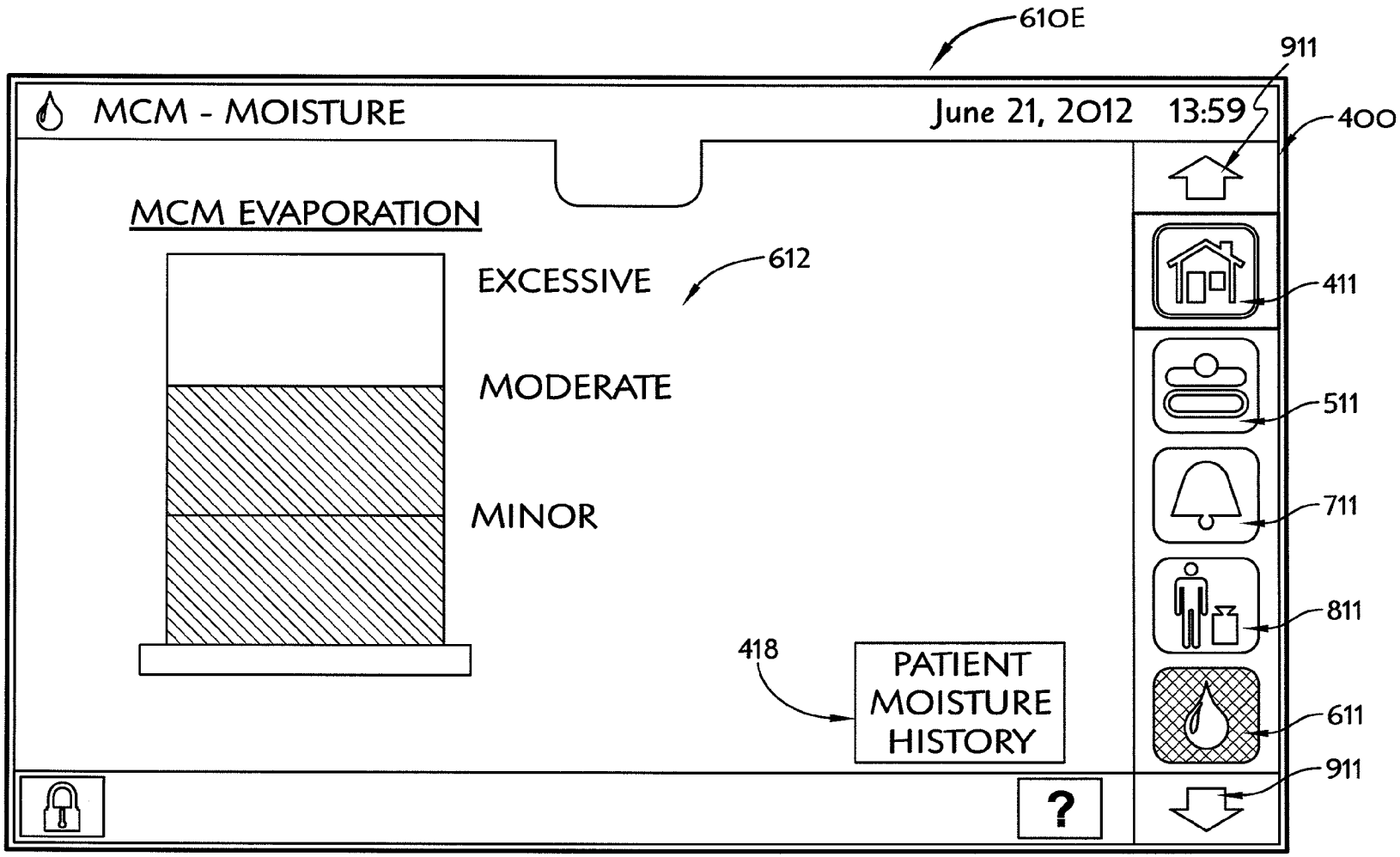
FIG. 16 is another alternative microclimate control system screen including a patient moisture history button and an evaporation slider for selecting a desired amount of evaporation to be provided by the microclimate system.

Another alternative microclimate control screen 610E is shown in FIG. 16. The alternative microclimate control screen 610E includes an evaporation input 612 and the patient moisture history button 418 as shown in FIG. 16. The evaporation input 612 is configured to send a user input command to the control circuitry 98 so that the control circuitry 98 adjusts both the air temperature conditioning unit 240 and the blower 230 based on a selection of a single desired evaporation value. In embodiments that do not include the air temperature conditioning unit 240, the selection of a desired evaporation value sends a user input command to the control circuitry 98 so that the control circuitry 98 adjusts the blower 230. The evaporation input 612 is illustratively an evaporation slider as shown in FIG. 16.

Figure 17:
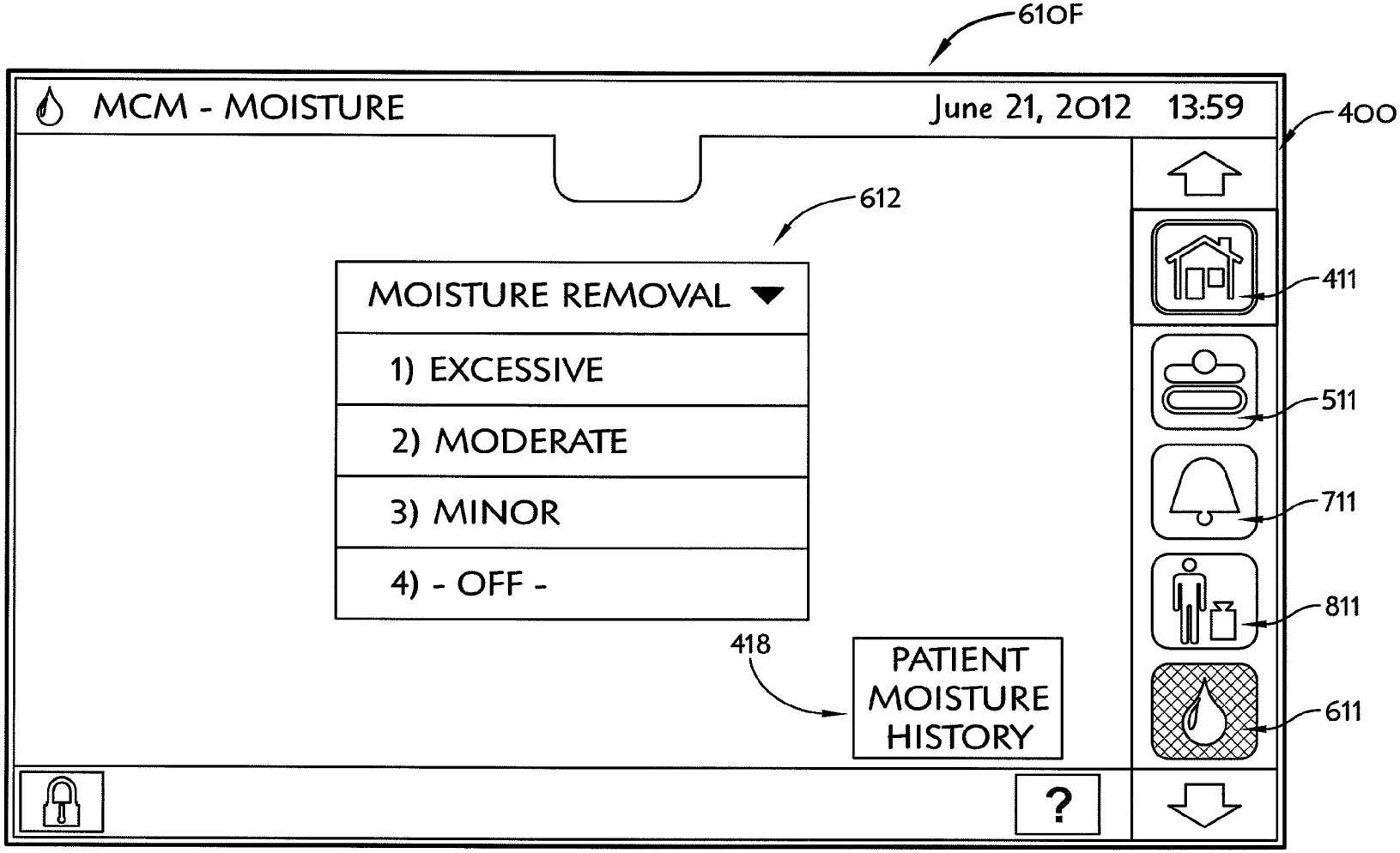
FIG. 17 is yet another alternative microclimate control system screen including a patient moisture history button and a moisture removal drop down list for selecting a desired amount of moisture removal to be provided by the microclimate system.

Another alternative microclimate control screen 610F is shown in FIG. 17. The alternative microclimate control screen 610F is substantially similar to microclimate control screen 610E except that the evaporation input 612F is drop down list for selecting a desired amount of moisture removal to be provided by the microclimate system as shown in FIG. 17.

The list of menu icons 400 provided on each screen displayed by the control circuitry 98 includes a home button 411, a surface button 511, an alarm button 711, and a scale button 811 as shown in FIGS. 5-17. When the home button 411 is pressed by a caregiver, the control circuitry 98 displays the home screen 410 as shown in FIG. 5. When the surface button 511 is pressed by a caregiver, the control circuitry 98 displays a surface screen (not shown) including controls for adjusting the pressure in the bladders 226 of the surface 22. When the alarm button 711 is pressed by a caregiver, the control circuitry 98 displays an alarm screen (not shown) including controls for setting alarm conditions, viewing triggered alarms, and resetting triggered alarms. When the scale button 811 is pressed by a caregiver, the control circuitry 98 displays a scale screen (not shown) including controls for taking patient weight and calibrating a scale integrated into the frame 20. Other buttons may be accessed by pressing arrows 911 included in the list of menu icons 400.

Although certain illustrative embodiments have been described in detail above, many embodiments, variations and modifications are possible that are still within the scope and spirit of this disclosure as described herein and as defined in the following claims.

The invention claimed is:

1. A patient support apparatus comprising a frame, a surface supported on the frame, the surface including a base and a first sensor, a graphical user interface coupled to the frame, and control circuitry coupled to the first sensor and to the graphical user interface, the control circuitry configured to receive outputs from the first sensor indicative of relative humidity in the support surface, the control circuitry being configured to establish a first moisture level and a second moisture level at a subsequent time from the first moisture level detected based at least in part on the outputs from the first sensor, to accumulate the amount of time spent at the first moisture level and second moisture level detected, to determine if the time spent at the first moisture level exceeds a corresponding first threshold time and to determine if the time spent at the second moisture level exceeds a corresponding second threshold time, the first and second threshold times being greater than zero, and if the time at the first moisture level exceeds the corresponding first threshold time, to display a moisture alert on the graphical user interface in response to the determination that the corresponding first threshold time at the first moisture level has been exceeded, and if the time at the second moisture level exceeds the corresponding second threshold time, to display a moisture alert on the graphical user interface in response to the determination that the corresponding second threshold time at the second moisture level has been exceeded.

2. The patient support apparatus of claim 1, wherein the moisture alert includes a request for a linen change.

3. The patient support apparatus of claim 2, wherein the moisture alert indicates an incontinent event.

4. The patient support apparatus of claim 2, wherein the control circuitry is configured to receive a reset input from the graphical user interface indicative that a linen change has been performed and to remove the alert in response to the reset input indicative that the linen change has been performed.

5. The patient support apparatus of claim 4, wherein the control circuitry is configured to hold for a dry out period of time in response to receiving the reset input from the graphical user interface indicative that a linen change has been performed before displaying another moisture alert on the graphical user interface in response to the outputs received from the first sensor.

6. The patient support apparatus of claim 4, wherein the control circuitry is configured to turn on a blower coupled to a topper included in the surface in response to receiving the reset input.

7. The patient support apparatus of claim 6, wherein the control circuitry is configured to hold for a dry out period of time in response to receiving the reset input from the graphical user interface indicative that a linen change has been performed before displaying another moisture alert on the graphical user interface in response to the outputs received from the first sensor.

8. The patient support apparatus of claim 7, wherein the control circuitry is configured to turn off the blower in response to expiration of the dry out period of time.

9. A patient support apparatus comprising a frame, a surface supported on the frame, the surface including a base and a first sensor, a graphical user interface coupled to the frame, control circuitry coupled to the first sensor and to the graphical user interface, the control circuitry configured to receive outputs from the first sensor indicative of relative humidity in the support surface and to determine a first moisture level and a second moisture level at a subsequent time from the first moisture level based on the outputs from the first sensor indicative of relative humidity in the support surface, and a clock outputting a date and time coupled to the control circuitry, wherein the control circuitry is configured to store the first moisture level, the second moisture level, and the date and time from the clock in a memory, and wherein the control circuitry is configured to compare the length of time spent at the first moisture level to a first threshold time and compare the length of time spent at the second moisture level to a second threshold time, the first and second threshold times being greater than zero, and to issue an alert if the time spent at the determined first or second moisture level is greater than the first or second threshold times, respectively.

10. The patient support apparatus of claim 9, wherein the control circuitry is configured to turn on a blower coupled to a topper included in the surface in response to the time spent at the determined moisture level being greater than the threshold.

11. The patient support apparatus of claim 10, wherein control circuitry is configured to display a moisture alert on the graphical user interface in response to the outputs received and to receive a reset input from the graphical user interface indicative that a linen change has been performed and to remove the alert and to turn off the blower in response to the reset input.

12. The patient support apparatus of claim 9, wherein the control circuitry is configured to receive a moisture-status request from the graphical user interface and to display moisture information in response to receiving the moisture-status request.

13. The patient support apparatus of claim 12, wherein the moisture information includes a line graph showing moisture level over time.

14. The patient support apparatus of claim 12, wherein the moisture information includes incontinent events over a time period.

15. The patient support apparatus of claim 12, wherein the moisture information includes a current moisture level.

16. The patient support apparatus of claim 9, further comprising a second sensor spaced apart from the surface, wherein the control circuitry is in communication with the second sensor and is configured to receive outputs from the second sensor indicative of relative humidity in the atmosphere around the support surface and to compare the outputs from the first sensor and the second sensor to determine a moisture level.

17. The patient support apparatus of claim 16, wherein the surface includes a topper extending over the base and the first sensor is housed in the base.

18. A patient support apparatus comprising a surface including a base with inflatable bladders, a ticking enveloping the base, and a topper extending over the base and coupled to the ticking, a pneumatic system including a blower operable at various speeds coupled to the topper of the surface to push air through the topper, a first sensor, a graphical user interface, control circuitry coupled to the pneumatic system, the first sensor, and to the graphical user interface, the control circuitry configured to adjust the speed of the blower in response to receipt of a user input from a microclimate control displayed on the graphical user interface, and the control circuitry configured to receive outputs from the first sensor indicative of relative humidity in the surface and to determine a first moisture level and a second moisture level at a subsequent time from the first moisture level based on the outputs from the first sensor, and a clock outputting a date and time coupled to the control circuitry, wherein the control circuitry is configured to store the moisture level and time from the clock in a memory, to compare the length of time spent at the first moisture level to a first threshold time and compare the length of time spent at the second moisture level to a second threshold time, the first and second threshold times being greater than zero, and to issue an alert if the time spent at the determined first or second moisture level is greater than the respective first or second threshold times.

19. The patient support apparatus of claim 18, wherein the control circuitry displays the microclimate control on the graphical user interface in response to the selection of a microclimate icon displayed on the graphical user interface.

20. The patient support apparatus of claim 18, wherein the microclimate control is operable by a user to increase or decrease blower speed.

21. The patient support apparatus of claim 20, wherein the microclimate control includes a flow knob rotatable about an axis between a low position and a high position.

22. The patient support apparatus of claim 20, wherein the microclimate control includes a series of selectable flow blocks arranged along a line.

23. The patient support apparatus of claim 20, wherein the microclimate control includes a flow slider movable along a line between a low position and a high position.

24. The patient support apparatus of claim 20, wherein the microclimate control includes a pair of selectable flow buttons operable by a user to increase or decrease blower speed.

25. The patient support apparatus of claim 18, wherein the pneumatic system includes an air temperature conditioning unit including a heater and a cooler, the air temperature conditioning unit configured to add and remove heat to air passed through the blower to the topper.

26. The patient support apparatus of claim 25, wherein the control circuitry is configured to adjust the air temperature conditioning unit in response to receipt of a user input from the microclimate control displayed on the graphical user interface.

27. The patient support apparatus of claim 26, wherein the control circuitry displays the microclimate control on the graphical user interface in response to the selection of a microclimate icon displayed on the graphical user interface.

28. The patient support apparatus of claim 27, wherein the microclimate control is operable by a user to increase or decrease the temperature of air passed through the blower.

29. The patient support apparatus of claim 28, wherein the microclimate control includes a temperature knob rotatable about an axis between a cool position and a warm position.

30. The patient support apparatus of claim 28, wherein the microclimate control includes a series of selectable temperature blocks arranged along a line.

31. The patient support apparatus of claim 28, wherein the microclimate control includes a temperature slider movable along a line between a cool position and a warm position.

32. The patient support apparatus of claim 28, wherein the microclimate control includes a pair of selectable temperature buttons.

33. The patient support apparatus of claim 26, wherein the microclimate control is operable to adjust both the blower speed and the air temperature conditioning unit with the selection of a single value.

34. The patient support apparatus of claim 33, wherein the microclimate control includes an evaporation slider.

35. The patient support apparatus of claim 33, wherein the microclimate control includes a moisture removal drop down list.

* * * * *